US007965952B2

(12) United States Patent
Tan et al.

(10) Patent No.: US 7,965,952 B2
(45) Date of Patent: Jun. 21, 2011

(54) REMAINING AMOUNT OF DEVELOPER DETECTION DEVICE, DEVELOPMENT DEVICE, PROCESS UNIT, AND IMAGE FORMING APPARATUS

(75) Inventors: Hongjie Tan, Shanghai (CN); Junlin Cai, Shanghai (CN); Chuanyi Yang, Shanghai (CN); Yoshitake Shimizu, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/712,532

(22) Filed: Feb. 25, 2010

(65) Prior Publication Data

US 2010/0232816 A1 Sep. 16, 2010

(30) Foreign Application Priority Data

Mar. 12, 2009 (CN) ..... 200910129036

(51) Int. Cl.
*G03G 15/08* (2006.01)

(52) U.S. Cl. ..... 399/27; 399/61

(58) Field of Classification Search ..... 399/9, 24, 399/25, 27, 58, 61, 107, 110, 111, 119, 120, 399/262, 263
See application file for complete search history.

(56) References Cited

U.S. PATENT DOCUMENTS

| | | | | |
|---|---|---|---|---|
| 4,916,490 | A * | 4/1990 | Tanaka et al. | 399/119 |
| 7,072,594 | B2 * | 7/2006 | Hoshi et al. | 399/27 |
| 7,254,357 | B2 | 8/2007 | Umezawa et al. | |

FOREIGN PATENT DOCUMENTS

| | | |
|---|---|---|
| JP | 62-118248 | 7/1987 |
| JP | 2-20887 | 1/1990 |
| JP | 9-120248 | 5/1997 |
| JP | 10-319704 | 12/1998 |
| JP | 11-84850 | 3/1999 |
| JP | 11-174812 | 7/1999 |
| JP | 11-194598 | 7/1999 |
| JP | 2001-183898 | 7/2001 |
| JP | 2006-98916 | 4/2006 |
| JP | 2006-267528 | 10/2006 |
| JP | 2007-298721 | 11/2007 |

* cited by examiner

*Primary Examiner* — Hoan Tran
(74) *Attorney, Agent, or Firm* — Oblon, Spivak, McClelland, Maier & Neustadt, L.L.P.

(57) ABSTRACT

A disclosed remaining amount of developer detection device includes a remaining amount of developer detection section detecting a remaining amount of developer in a development device, an operation amount computation section computing an operation amount of the development device corresponding to a developer consumption amount, and a remaining amount detection control section accumulating the operation amount and detecting the remaining amount of developer based on the accumulated operation amount. In this device, when the remaining amount of developer detection section has detected the remaining amount of developer that has been reduced to a first threshold, the remaining amount detection control section initializes the accumulated operation amount and starts accumulating a new operation amount of the development device corresponding to a developer consumption amount, and determines whether the remaining amount of developer in the development device is in a toner-end status based on the new operation amount.

18 Claims, 25 Drawing Sheets

REMAINING AMOUNT OF DEVELOPER DETECTION DEVICE, DEVELOPMENT DEVICE, PROCESS UNIT, AND IMAGE FORMING APPARATUS

BACKGROUND OF THE INVENTION

1. Field of the Invention

The invention relates to a remaining amount of developer detection device, a development device, a process unit, and an image forming apparatus, and more specifically, to a remaining amount of developer detection device capable of detecting an amount of toner remaining in a development device included in an image forming apparatus such as copier, a printer, and a facsimile machine.

2. Description of the Related Art

The related art image forming apparatus having an electrophotographic system generally includes a development device configured to form an electrostatic latent image on the surface of an image carrier and provide a developer on the electrostatic latent image to develop the electrostatic latent image, thereby forming a visible image. The developer system of the image forming apparatus includes two major systems: 1) a two-component developer system; and 2) a single-component developer system. The two-component developer system employs a developer containing toner and a magnetic carrier, and the single-component developer system employs a developer containing toner only without a magnetic carrier. The single-component developer system further includes subsystems, namely, a magnetic single-component toner system and non-magnetic single-component toner system.

In the single-component system, since this type of developer does not contain a magnetic carrier, it is not necessary to mix the toner and the magnetic carrier by stirring. Thus, the development device for the single-component system can be made simpler and smaller in size than the development device for the two-component developer system.

However, toner is consumable and is contained in a cartridge, which is placed in a cartridge holder of the development device. The amount of toner decreases as the number of printed images increases. Since the cartridge of the toner attached to the cartridge holder (hereinafter called a "toner container chamber") is located inside a developer unit of the development device, it is hard to check the remaining amount of toner from outside of the development device with the naked eye. Thus, the toner container chamber generally includes a sensor unit for detecting the remaining amount of toner. That is, the development device includes a remaining amount of toner detection sensor that detects the amount of toner, such as a piezoelectric element, and generates, upon detection of shortage of toner, a signal to notify a user of the shortage by displaying an alarm. Thus, the user is notified by the display of the shortage of toner, so that the user can replace the development device with a new one, or replace the toner cartridge with a new one. As described above, in order to detect the remaining amount of toner, it is preferable to provide a remaining amount of toner detection sensor in the development device or a process unit containing the development device. However, these days image forming apparatuses are desired to be reduced in size and prices, and therefore development devices utilized for such apparatuses are also desired to contain low-price sensors.

As the related art technology for detecting a remaining amount of toner, Japanese Utility Model Registration Application Laid-Open Publication No. 62-118248 discloses a toner near-end detecting device for detecting the shortage of toner. The disclosed toner near-end detecting device includes a scooper scooping the toner remaining in a toner hopper and a toner detector with which the toner remaining in the toner hopper is brought into contact to generate a signal based on the contact load of the toner.

Japanese Patent Application Laid-Open Publication No. 02-20887 also discloses a similar technology, that is, a remaining amount of toner detection device for detecting the remaining amount of toner. The disclosed remaining amount of toner detection device includes a lever moving upward and downward in a toner container chamber and pressing toner when moving downward in the toner container chamber, and a lever movement detector detecting one end of the lever projecting from the toner container chamber. However, those toner detecting devices disclosed in the two publications above are configured to detect the amount of toner remaining in the toner hopper. This indicates that the disclosed toner detecting devices do not detect the amount of toner remaining near a development roller. The toner remaining near the development roller is directly used for developing images. Accordingly, the disclosed toner detecting devices may have low accuracy in detecting the remaining amount of the toner used for developing images. Further, it is difficult to reduce sizes of these devices. Moreover, these devices include a movable member for detecting the remaining amount of toner, and as a result, the devices have a complex structure.

Meanwhile, when a rotary member of the device such as a stirring member is rotated to stir the toner, the toner may be caught in an interspace between a rotary shaft and a shaft bearing. The toner stuck between the shaft and bearing melts due to friction heat generated from the rotary shaft, which inhibits the shaft from rotating. Japanese Patent Application Laid-Open Publication No. 11-194598 discloses a powder container chamber provided for a development device. The powder container chamber contains powder, and includes a rotor having a shaft rotated based on a shaft end slotted into a bearing hole in an internal wall of the container chamber, the shaft end having a screw groove cut in a direction returning to the inside of the container chamber from a rotating direction of the rotor. Japanese Patent Application Laid-Open Publication No. 2006-098916 discloses a development device that includes a developer exclusion member attached to a rotating shaft of a development roller supported by a bearing member in a housing, and a bearing supporting the rotating shaft. In the development device, lubricant is supplied in an interspace between the developer exclusion member and the bearing. However, the technology disclosed by Japanese Patent Application Laid-Open Publication No. 11-194598 may not sufficiently remove the toner that is stuck in an interspace between the bearing and the shaft. Further, the technology disclosed by Japanese Patent Application Laid-Open Publication No. 11-194598 may not sufficiently prevent the toner from being stuck in the interspace between the shaft and shaft bearing member. In this technology, the lubricant catches toner stuck in the interspace between the shaft and shaft bearing member to prevent the toner from sticking. Thus, if a large amount of the toner is supplied, the disclosed technology may not sufficiently prevent the toner from sticking in the interspace.

As another method of excluding the toner, there is disclosed a toner remaining amount detector that is provided in the toner container chamber. The disclosed toner remaining amount detector mechanically detects a remaining amount of toner. For example, Japanese Patent Application Laid-Open Publication No. 10-319704 discloses a development device 8*a* (reference numerals provided herein are employed from the disclosed references) having a developer container chamber 8, a stirring bar 11 moving straightforward according to resistance against the toner 5 increased by stirring the toner 5, and a sensor 12 detecting a moving state of the stirring bar 11, thereby detecting the remaining amount of toner. The stirring bar 11 includes an arm base 11*b* and an arm point 11*a* shaft connected to the arm base lib, so that the stirring bar 11 can be bent in a rotational direction of the stirring bar 11. In the development device 8, the sensor 12 is located such that the sensor 12 generates an alarm when the amount of toner reaches a desired position. In this development device 8, when the toner amounts to a certain amount where an alarm is generated, the stirring bar 11 is bent in a rotational direction of the stirring bar 11 so that the sensor 12 does not detect the end point of the stirring bar 11. Accordingly, it is possible to realize stepwise detection of the remaining amount of toner in the developer container chamber 8*a*. Further, Japanese Patent Application Laid-Open Publication No. 11-84850 discloses a development device in which a toner contained in a toner container chamber 10*a* is transferred toward a development roller 10*d* by toner transfer member 10*b* that rotatably transfers the developer. In this development device, a gear coupled with a driver source is provided with an end of the toner transfer member 10*b*, an encoder plate 16 projecting outside of the toner container chamber 10*a* is provided with the other end of the toner transfer member 10*b*, and a photosensor 17 having a luminous unit 17*a* and a photodetecting unit 17*b* is provided to cover the periphery of the encoder plate 16. The photosensor generates a pulse wave according to rotation of the encoder plate 16, and monitors the pulse wave, so that a toner near end of the toner container chamber 10*a* and a toner near end of the development device can both be detected. Moreover, Japanese Patent Application Laid-Open Publication No. 11-174812 discloses a development device in which a float 1 is provided in a toner container chamber A, and the remaining amount of the toner is detected by causing an angle sensor to read the position of the float 1, thereby notifying a user of the remaining amount of the toner.

However, with this method, the remaining amount of toner detection unit detects only an approximate amount of the toner remaining in the container chamber, indicating to a user that soon no toner will be left in the container chamber, and does not notify the user of an accurate amount of the toner remaining in the container chamber at each detection.

Further, there is disclosed a technology in which the amount of toner consumed can be sequentially detected in an image forming apparatus. A method in which the amount of toner consumption is sequentially detected is disclosed in Japanese Patent Application Laid-Open Publication No. 2007-298721. With this technology, the number of pixels is counted based on image data, and the amount of the toner consumption can be determined based on the counted pixels of the image data. The counted pixels may also be corrected based on density of the image, so that a more accurate remaining amount of toner can be computed.

However, with the above sequential detection model, the number of pixels is counted based on the image data, and the amount of the toner consumption can be determined based on the counted pixels of the image data. With this model, errors in computing the consumed amount of toner may be generated according to types of the images such as an image formed of lines and an image formed of separate dots.

Further, various technologies or methods disclosed above may be combined so as to detect the remaining toner stepwise, or to detect the remaining toner more accurately. For example, Japanese Patent Application Laid-Open Publication No. 9-120248 discloses a development device including a remaining amount of toner detection unit 9 detecting toner 7 stored in a developer container chamber 6 and a storage unit 6. In this development device, the remaining amount of toner detection unit 9 detects the remaining amount of toner in the developer container chamber 6 by detecting electrostatic capacity between an electrode and a developing sleeve 3, and the storage unit 60 stores a counted value based on an image signal. When the remaining amount of toner detection unit 9 detects the remaining amount of toner amounting equal to or less than a predetermined value, the remaining amount of toner detection unit 9 initiates counting the value to compute the remaining amount of toner based on the counted value, thereby detecting a toner-near-end, indicating an amount of the toner being approximately zero. Japanese Patent Application Laid-Open Publication No. 2001-183898 discloses an image forming apparatus that includes an optical transmission sensor 5 and a pixel value counting unit 2. In this image forming apparatus, when printing starts, both the optical transmission sensor 5 and the pixel value counting unit 2 detect the remaining amount of toner. If the optical transmission sensor 5 detects the amount of toner being equal to or less than a predetermined amount, an accumulated count value counted by the pixel value counting unit 2 is corrected based on the detected amount of toner, and the remaining amount of toner is displayed based on the corrected count value.

Japanese Patent Application Laid-Open Publication No. 2006-267528 discloses an image forming apparatus that includes an image forming unit 5 having a toner container chamber unit 24 and a toner sensor lever 25 located at a distance from a supplying roller 29, the toner sensor lever 25 being rotatable and having a crank shape. The image forming apparatus further includes a sensor 25*a* that detects a crank shift of the toner sensor lever 25 so that the amount of toner remaining in the toner container chamber unit 24 is equal to or less than a predetermined value. Further, when the sensor 25*a* detects the amount of toner being equal to or less than the predetermined value, a video processing circuit initiates dot counting, and reports that a toner-near-end condition indicating the toner is approximately zero if the amount of toner reaches a predetermined value.

However, with the combination of various detecting units or methods, computing the remaining amount of toner inevitably generates errors according to positions of the sensors or timing at which sensor detection is switched to pixel count detection. Moreover, in this apparatus, a mechanical toner remaining amount detection unit provided in a toner container chamber interferes with a flow of toner around a development roller, and the mechanical toner remaining amount detection unit may not detect the remaining amount of toner accurately if toner container chamber surfaces have local curves.

SUMMARY OF THE INVENTION

Accordingly, embodiments of the present invention may provide a novel and useful development device utilized for an image forming apparatus capable of solving one or more of the problems discussed above. More specifically, the embodiments of the present invention may provide a development device that includes a detection member configured to mechanically detect a first toner-near-end (or toner-end), and further detect a second toner-near-end (or toner-end) after the first toner-near end detection more accurately with a smaller and simpler configuration.

According to an aspect of the embodiments, a remaining amount of developer detection device includes a remaining amount of developer detection section configured to detect a remaining amount of developer in a development device; an operation amount computation section configured to compute an operation amount of the development device corresponding to a developer consumption amount of the development device; and a remaining amount detection control section configured to accumulate in a storage section the operation amount of the development device corresponding to the developer consumption amount of the development device computed by the operation amount computation section and detect the remaining amount of developer in the development device based on the accumulated operation amount stored in the storage section. In the remaining amount of developer detection device, the remaining amount of developer detection section includes a detection member configured to change a rotational position corresponding to the remaining amount of developer in the development device and include a rotational shaft and a plate-like member attached to the rotational shaft and located near a supply member that supplies a developer in a direction toward a development region such that the plate-like member goes up in a direction in which a distance between the plate-like member and the supply member is increased and goes down in a direction in which a distance between the plate-like member and the supply member is decreased in a space in the development device; a driving force transmission device configured to apply a driving force to the detection member at a time of detecting the remaining amount of developer in the development device such that the plate-like member goes up in the direction in which the distance between the plate-like member and the supply member is increased and goes down in the direction in which the distance between the plate-like member and the supply member is decreased; and a sensor configured to detect a rotation state of the plate-like member when the plate-like member goes down to near a lowermost position thereof. Further, in the remaining amount of developer detection device, provided that the remaining amount of developer detection section has detected the remaining amount of developer that has been reduced to a first threshold, the remaining amount detection control section initializes the accumulated operation amount stored in the storage section and starts accumulating in the storage section a new operation amount of the development device corresponding to a developer consumption amount of the development device computed by the operation amount computation section, and determines whether the remaining amount of developer in the development device is in a toner-end status based on the new operation amount accumulated in the storage section.

According to an aspect of the embodiments, a development device includes a remaining amount of developer detection device including a remaining amount of developer detection section configured to detect a remaining amount of developer in a development device; an operation amount computation section configured to compute an operation amount of the development device corresponding to a developer consumption amount of the development device; and a remaining amount detection control section configured to accumulate in a storage section the operation amount of the development device corresponding to the developer consumption amount of the development device computed by the operation amount computation section and detect the remaining amount of developer in the development device based on the accumulated operation amount stored in the storage section. In the development device, the remaining amount of developer detection section includes a detection member configured to change a rotational position corresponding to the remaining amount of developer in the development device and include a rotational shaft and a plate-like member attached to the rotational shaft and located near a supply member that supplies a developer in a direction toward a development region such that the plate-like member goes up in a direction in which a distance between the plate-like member and the supply member is increased and goes down in a direction in which a distance between the plate-like member and the supply member is decreased in a space in the development device; a driving force transmission device configured to apply a driving force to the detection member at a time of detecting the remaining amount of developer in the development device such that the plate-like member goes up in the direction in which the distance between the plate-like member and the supply member is increased and goes down in the direction in which the distance between the plate-like member and the supply member is decreased; and a sensor configured to detect a rotation state of the plate-like member when the plate-like member goes down to near a lowermost position thereof. Further, in the development device, provided that the remaining amount of developer detection section has detected the remaining amount of developer that has been reduced to a first threshold, the remaining amount detection control section initializes the accumulated operation amount stored in the storage section and starts accumulating in the storage section a new operation amount of the development device corresponding to a developer consumption amount of the development device computed by the operation amount computation section, and determines whether the remaining amount of developer in the development device is in a toner-end status based on the new operation amount accumulated in the storage section.

According to an aspect of the embodiments, an image forming apparatus includes an image carrier forming a latent image; and a development device developing the latent image with developer. In the image forming apparatus, the development device includes a remaining amount of developer detection device including a remaining amount of developer detection section configured to detect a remaining amount of developer in the development device; an operation amount computation section configured to compute an operation amount of the development device corresponding to a developer consumption amount of the development device; and a remaining amount detection control section configured to accumulate in a storage section the operation amount of the development device computed corresponding to the developer consumption amount of the development device computed by the operation amount computation section and detect the remaining amount of developer in the development device based on the accumulated operation amount stored in the storage section. Further, in the image forming apparatus, the remaining amount of developer detection section includes a detection member configured to change a rotational position corresponding to the remaining amount of developer in the development device and include a rotational shaft and a plate-like member attached to the rotational shaft and located near a supply member that supplies a developer in a direction toward a development region such that the plate-like member goes up in a direction in which a distance between the plate-like member and the supply member is increased and goes down in a direction in which the distance between the plate-like member and the supply member is decreased in a space in the development device; a driving force transmission device configured to apply a driving force to the plate-like member such that the plate-like member goes up in the direction in which the distance between the plate-like member and the supply member is increased and goes down in the direction in which the distance between the plate-like member and the supply member is decreased; and a sensor configured to detect a rotation state of the plate-like member when the plate-like member goes down to near a lowermost position thereof. Moreover, in the image forming apparatus, provided that the remaining amount of developer detection section has detected the remaining amount of developer that has been reduced to a first threshold, the remaining amount detection control section initializes the accumulated operation amount stored in the storage section and starts accumulating in the storage section a new operation amount of the development device corresponding to a developer consumption amount of the development device computed by the operation amount computation section, and determines whether the remaining amount of developer in the development device is in a toner-end status based on the new operation amount accumulated in the storage section.

Additional objects and advantages of the embodiments will be set forth in part in the description which follows, and in part will be obvious from the description, or may be learned by practice of the invention. It is to be understood that both the foregoing general description and the following detailed description are exemplary and explanatory only and are not restrictive of the invention as claimed.

DETAILED DESCRIPTION OF THE PREFERRED EMBODIMENTS

A description is given below, with reference to FIGS. 1 through 23 of preferred embodiments of the invention. While the invention has been particularly shown and described with reference to the preferred embodiments, it will be understood by those skilled in the art that changes in form and details may be made therein without departing from the spirit and scope of the invention.

An image forming apparatus having a development device according to a first embodiment of the invention includes an image carrier, a charging section, a laser illumination section, a development section, a transfer section, and a fixation section. The image forming apparatus may further include other optional sections such as a static eliminating section, a cleaning section, a recycling section, and a control section. Hereinafter, the image forming apparatus having the development device is specifically described.

Figure 1:
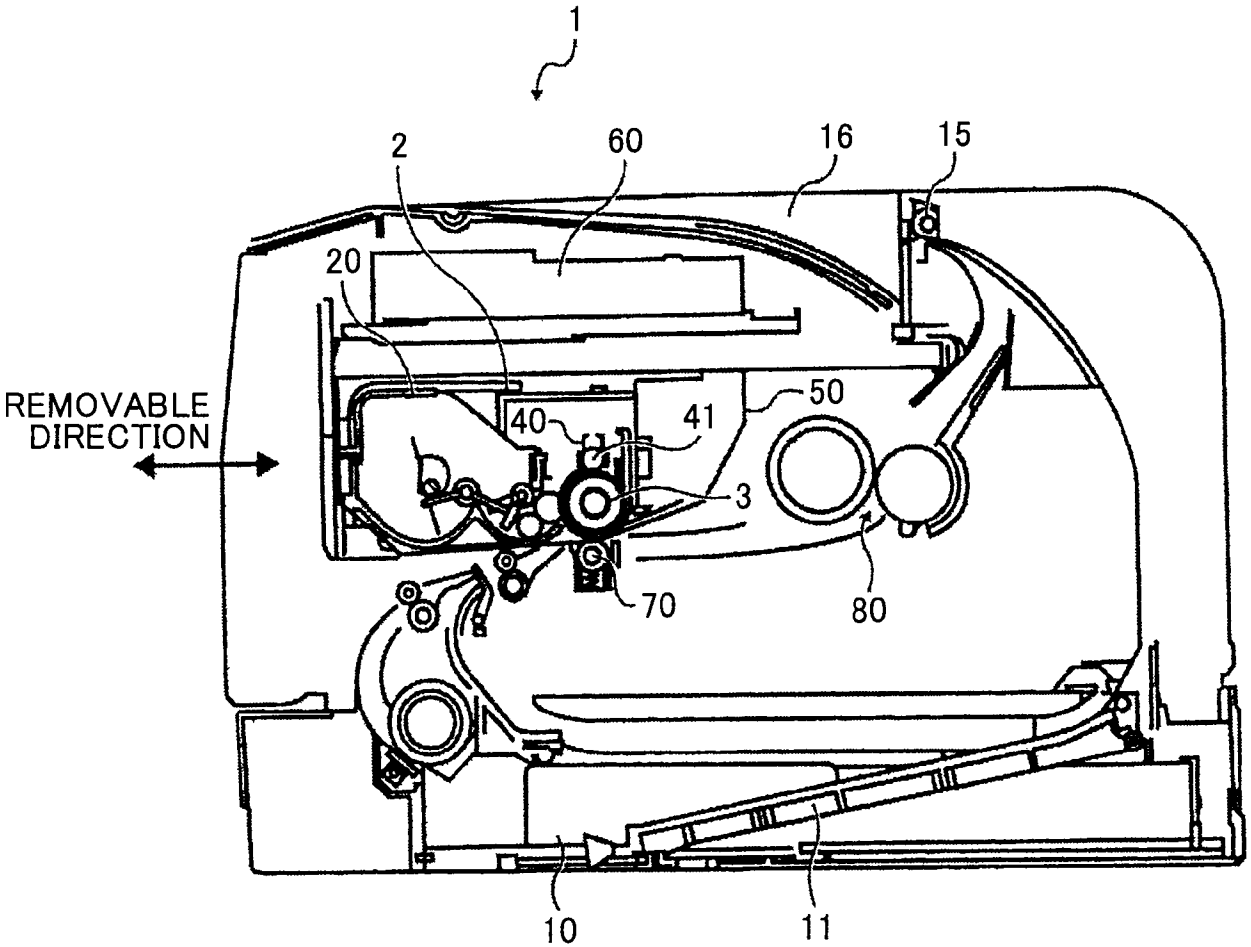
FIG. 1 is a diagram illustrating a configuration of an image forming apparatus having a development device according to a first embodiment of the invention.
Figure 2:
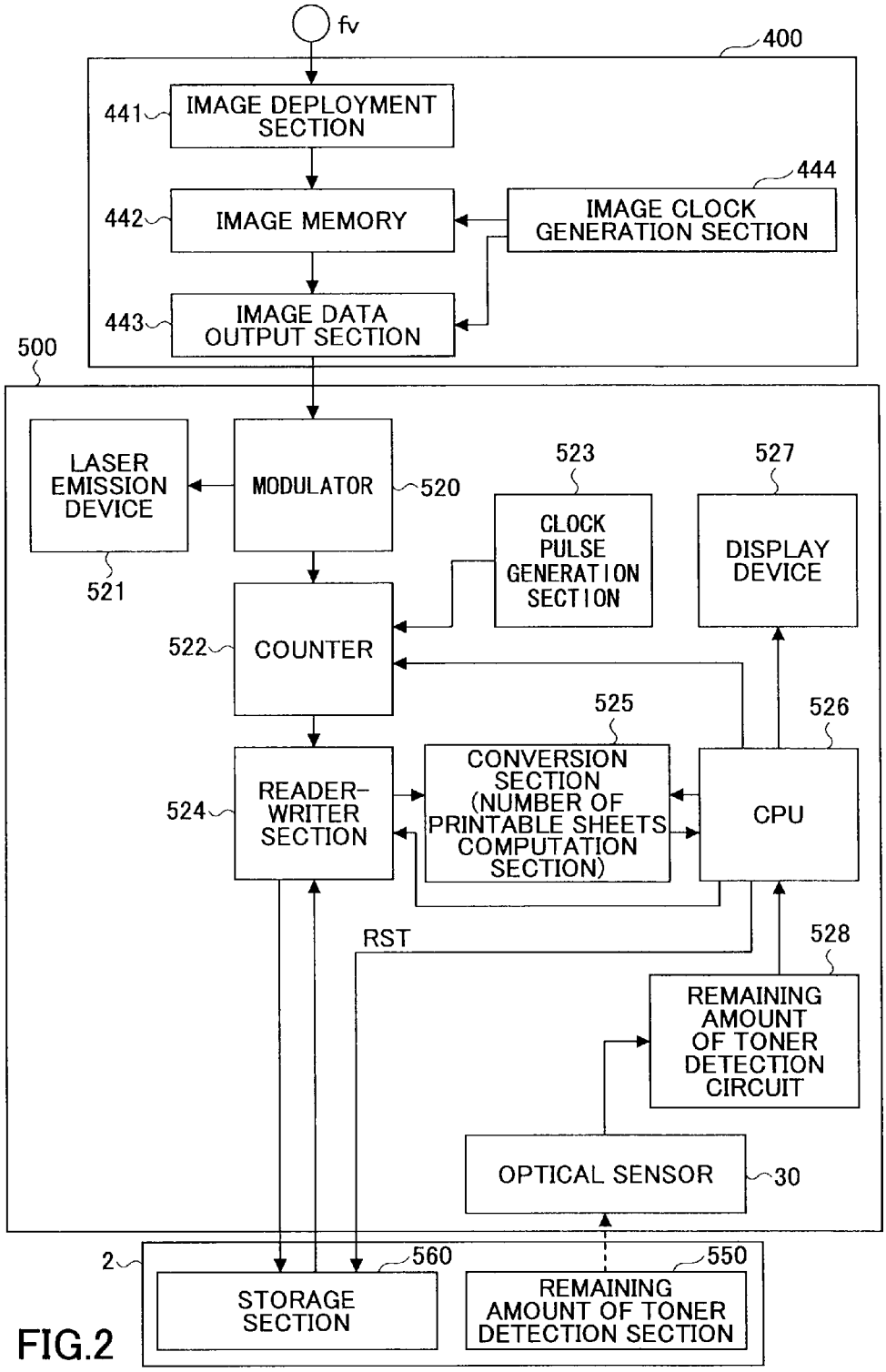
FIG. 2 is a circuit block diagram of the image forming apparatus according to the first embodiment of the invention.

FIG. 1 is a diagram illustrating a configuration of an image forming apparatus 1 having a development device 20 according to a first embodiment of the invention. FIG. 2 is a circuit block diagram of the image forming apparatus 1 having the development device 20 according to the first embodiment of the invention.

As illustrated in FIG. 1, the image forming apparatus 1 includes a process unit 2 arranged in the center of the image forming apparatus 1, and a paper-feed unit 10 having a paper-feed cassette 11 arranged below the process unit 2. The image forming apparatus 1 further includes an exposure device 60 arranged above the process unit 2, so that the exposure device 60 applies a laser beam to a drum-shaped photoreceptor 3 to form a latent image on the drum-shaped photoreceptor 3. The process unit 2 includes the photoreceptor 3, a charging device 40 charging a surface of the photoreceptor 3, a development device 20 making an electrostatic latent image formed on the surface of the photoreceptor 3 visible by the application of toner, and a cleaning device 50 removing the toner remaining on the surface of the photoreceptor 3. The image forming apparatus 1 further includes a transfer device 70 transferring a toner image formed on the photoreceptor 3 onto a recording sheet, and a fixation device 80 fixing the toner image on the recording sheet by allowing the recording sheet to pass through between two rollers so as to apply heat and pressure to the recording sheet. As described above, the image forming apparatus 1 has a printer function to record an image on the recording sheet based on digitized image information. However, the image forming apparatus 1 may further include a control unit so as to function as a multi-functional image forming apparatus, which includes various other functions such as a facsimile machine function transmitting the image information to or receiving the image information from a remote location, a reader reading an original document, and a document conveyance device.

Various process steps carried out by the image forming apparatus 1 are described below. Note that material, shape, structure and size of the photoreceptor 3 may be selected in accordance with the intended use. Examples of the shapes of the photoreceptor 3 include a drum shape, a sheet shape and an endless-belt shape. The size of the photoreceptor 3 may be selected in accordance with the size of the image forming apparatus 1. Examples of the materials used for the photoreceptor 3 include an inorganic photoreceptor such as amorphous silicon, selenium, cadmium sulfide (CdS), and zinc oxide (ZnO), or an organic photoreceptor (OPC) such as polysilane and phthalopolymethine. Structures of such organic photoreceptors include a single layer structure and a multiple layer structure. The photoreceptor having a single layer structure includes a base and a single photoreceptor layer attached to the base, and may optionally include a protective layer, an intermediate layer, and other layers. The photoreceptor having a multiple layer structure includes a base and multiple photoreceptor layers including a charge-generating layer and a charge-transporting layer attached in this order to the base, and may optionally include a protective layer, an intermediate layer, and other layers.

In a charging step, a surface of the photoreceptor 3 is charged by the charging device 40. The charging device 40 uniformly charges the surface of the photoreceptor 3 by the application of voltage. The charging device 40 includes two types of the charging devices, namely, a contact type charging device by which the photoreceptor 3 is charged by making contact with the charging device 40, and a non-contact type charging device by which the photoreceptor 3 is charged without making contact with the charging device 40. Examples of the contact type charging device include a conductive or non-conductive semiconductor charging roller, a magnetic brush, a fur brush, a film, and a rubber blade. Among these, the charging roller can lower the generation of ozone more significantly than a corona discharge device, and therefore, may exhibit excellent stability in repeatedly charging the photoreceptor 3. Accordingly, the charging roller may be effective in preventing degradation of image quality. A charging roller 41 according to the first embodiment of the invention includes a cored bar as a cylindrical conductive base, a resistant adjustment layer formed over the external peripheral surface of the cored bar and a protective layer coated over the surface of the resistance adjustment layer to prevent charge leakage. The charging roller 41 is connected to the power source and has a predetermined voltage applied. The charging roller 41 may have applied a direct current (DC) voltage only; however, it may preferably have applied a voltage obtained by superimposing an alternating current (AC) voltage on the DC voltage. Accordingly, the surface of the photoreceptor 3 may be uniformly charged by the application of the AC voltage.

Examples of the non-contact type charging device include a non-contact charging wire using the corona discharge, a needle electrode device, and a conductive or non-conductive charging roller provided adjacent to the photoreceptor 3 with a narrow gap inbetween. The corona discharge indicates a non-contact charge method in which positive or negative ions generated by corona discharge in the air are given to the surface of the photoreceptor 3. Examples of the corona discharge devices include a corotron charging device having a characteristic of giving a predetermined amount of charges to the photoreceptor 3, and a scorotron charging device having a characteristic of giving a predetermined potential to the photoreceptor 3. The corotron charging device includes a discharging wire and a casing electrode containing the discharging wire placed approximately at its center and half-spaced around the discharging wire. The scorotron charging device includes the corotron charging device and a grid electrode, which is provided at a position 1.0 to 2.0 mm distant from the surface of the photoreceptor 3. The charging roller is improved such that the charging roller is provided adjacent to the photoreceptor 3 with a narrow gap inbetween. The narrow gap may preferably in a range from 10 to 200 μm and more preferably in a range from 10 to 100 μm.

In an exposure step, the surface of the charged photoreceptor 3 is exposed by the exposure device 60. More specifically, imagewise exposure is carried out by the exposure device 60 on the surface of the photoreceptor 3. The optical system used for the exposure may be an analog optical system or a digital optical system. The analog optical system projects an original document image directly onto the photoreceptor 3, whereas the digital optical system is supplied with an electric signal of image information of an original document, and converts the electric signal into an optical signal by exposure to form an image. The exposure device may be any type exposure device so long as a desired image can be exposed onto the receptor 3 based on the information and may be selected in accordance with the intended use. Examples of the exposure devices include a rod lens array system, a liquid-crystal shutter optics system, and an LED optics system, however, a laser optics system is particularly preferable.

In a developing step, an electrostatic latent image is developed by a development device 20 containing toner to form a visible image. The development device 20 develops the electrostatic latent image with a single-component developer. The single-component developer may be magnetic toner or non-magnetic toner. Details of the development device 20 are described later.

In a transferring step, the visible image is transferred onto a recording medium by a transfer device 70. The transfer device 70 may be a direct transfer type device by which the visible image on the photoreceptor 3 is directly transferred onto the recording medium, or a secondary transfer type device by which the visible image on the photoreceptor 3 is initially transferred onto an intermediate transfer member and then the image transferred on the intermediate transfer member is subsequently transferred onto the recording medium. However, the direct transfer type is preferable for the transfer device 70 in the first embodiment. Examples of the transfer device 70 include a corona transfer device using the corona discharge, a transfer belt, a transfer roller, a pressure transfer roller, and an adhesive transfer device. In the first embodiment, the roller type transfer device 70 is employed. Note that the recording medium may be any type of recording medium so long as a post-development unfixed image may be transferred thereon, and the type of the recording medium may be selected in accordance with the intended use. For example, a PET type base used for an OHP may be used.

In a fixing step, the visible image transferred on the recording medium is fixated by the fixation device 80. The fixation device 80 may be any type of the fixation device; however, it is preferable that the fixation device 80 include a combination of fixation members and a heat source heating the combination of the fixation members. The preferable combination of fixation members may be capable of forming a nip portion by allowing the fixation members to contact each other, examples of which include a combination of an endless belt and a roller, and a combination of rollers. If the fixation member is a roller, a cored bar of the roller is preferably formed of an inelastic member to prevent the roller from deforming due to high pressure. The inelastic member may be any inelastic member selected in accordance with the intended use; however, a high thermal conductivity material such as aluminum, iron, stainless steel, and brass is preferable. Further, the surface of the roller is preferably coated with an offset prevention layer. Materials for forming the offset prevention layer may be selected in accordance with the intended use, example of include RVT silicone rubber, tetrafluoroethylene-perfluoroalkyl vinyl ether (PFA), and polytetrafluoroethylene (PTFE). In the fixing step, the image is fixated on the recording medium by initially transferring the toner image onto the recording medium and allowing the recording medium having the transferred image to pass through the nip portion. Alternatively, the toner image is transferred and fixed on the recording medium simultaneously.

In a cleaning step, the toner remaining on the surface of the photoreceptor 3 is removed by a cleaning device 50. Alternatively, while the development device 20 develops the electrostatic latent image formed on the photoreceptor 3 using a development roller 21 by being brought in contact with the surface of the photoreceptor 3, the development device 20 collects the toner remaining on the surface of the photoreceptor 3. With this configuration, the toner remaining on the surface of the photoreceptor may be removed or cleaned without specifically having the cleaning device 50. The cleaning device 50 may be any type of a cleaning device that can remove the toner remaining on the surface of the photoreceptor 3, and may be selected in accordance with the intended use. Examples of the cleaning device include a magnetic brush cleaner, an electrostatic brush cleaner, a magnetic roller cleaner, a cleaning blade, a brush cleaner, and a web cleaner. Among these, the cleaning blade 51 is particularly preferable due to its high toner removing ability, a compact shape, and a low price. Examples of a material for rubber blade of the cleaning blade 51 include urethane rubber, silicone, rubber, fluorocarbon rubber, chloroprene-rubber, and butadiene rubber. Among these, urethane rubber is particularly preferable.

(Operations Flow)

Next, operations flow of the image forming apparatus 1 according to the first embodiment is described below.

As illustrated in FIG. 1, the surface of the photoreceptor 3 is uniformly charged while the photoreceptor 3 is rotationally driven by the charging roller 41 of the charging device 40, and the surface of the photoreceptor 3 is then scanned with a laser beam emitted by the exposure device 60, thereby forming on electrostatic latent image on the surface of the photoreceptor 3. The exposure scanning is carried out on the surface of the photoreceptor 3 based on external image information. The photoreceptor 3 is provided inside the process unit 2 that integrally assembles the charging device 40, the development device 20, and the cleaning device 50. The electrostatic latent image formed on the photoreceptor 3 is developed by the development device 20 of the process unit 2, thereby forming a visible image. The transfer device 70 is provided rotationally downstream of the photoreceptor 3. A recording sheet fed from a paper-feed cassette 11 is conveyed from two rollers of a resist roller (not shown) to a transfer region such that the visible image on the photoreceptor 3 can be transferred onto the recording sheet placed in the transfer region. The visible image on the photoreceptor 3 can be transferred onto the recording sheet placed in the transfer region by the transfer device 70. The drum cleaning device 50 cleans the surface of the photoreceptor 3 that has passed through the transfer region by removing the remaining toner from the surface of the photoreceptor 3. In the drum cleaning device 50, the remaining toner is removed by a cleaning roller to which a cleaning bias is applied.

The recording sheet having the visible image is conveyed to the fixation device 80. The recording sheet being conveyed is sandwiched in a fixation region formed between the fixation roller and the pressure roller mutually in contact. The visible image on the recording medium is fixated in the fixation region by heat generated from the fixation roller and pressure applied by the pressure roller. Thereafter, the recording sheet is conveyed from the fixation device 80 to a paper discharge tray 16, by passing through a paper discharge roller 15.

Figure 3:
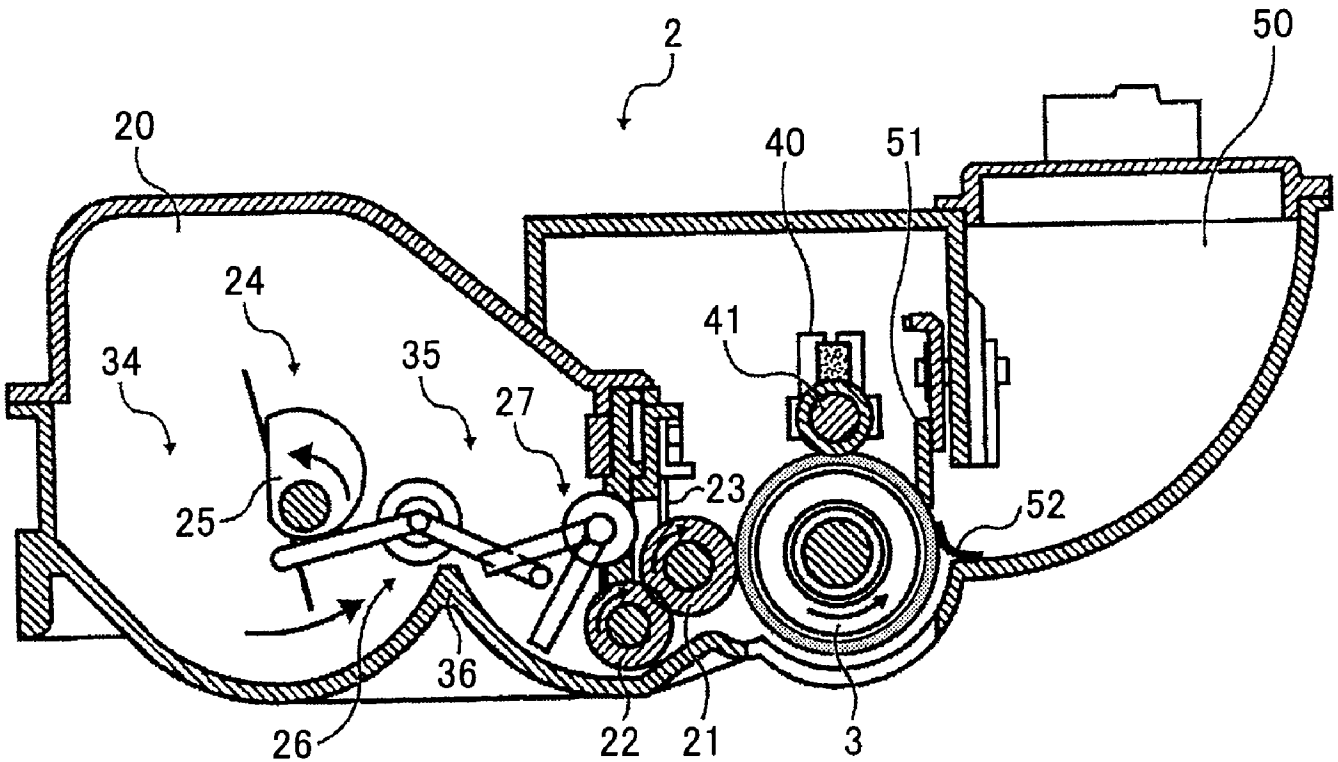
FIG. 3 is a diagram illustrating a configuration of a process unit.

Next, details of the process unit are described. FIG. 3 is a diagram illustrating a configuration of the process unit 2. As illustrated in FIG. 3, the process unit 2 according to the first embodiment includes the photoreceptor 3 and the charging device 40 having the charging roller 41 charging the photoreceptor 3, the development device 20 developing the latent image formed on the photoreceptor 3, and the cleaning device 50 having the cleaning blade 51 removing the toner remaining on the surface of the photoreceptor 3. The process unit 2 is removably attached to the image forming apparatus 1. As illustrated in FIG. 1, the process unit 2 can be attached from the side of the image forming apparatus 1 by inserting it along guide units such as guide rails provided in the image forming apparatus 1. With this configuration, components of the process unit 2 such as the photoreceptor 3 can be easily replaced with new ones in a short time, thereby reducing maintenance time and cost. Further, since the above devices of the process unit 2 are integrally assembled, relative positions between the devices are accurately retained.

Figure 4:
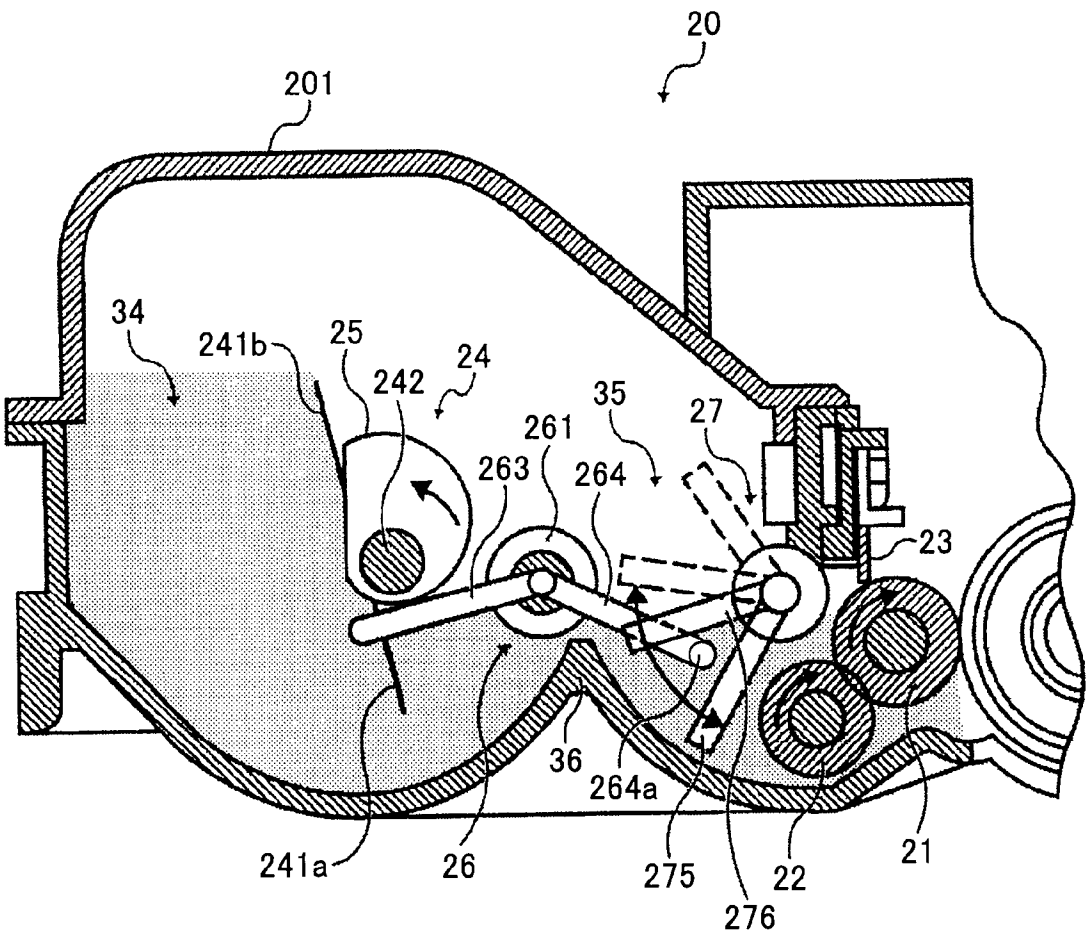
FIG. 4 is a diagram illustrating a configuration of a development device according to the first embodiment of the invention.

FIG. 4 is a diagram illustrating a configuration of the development device 20 according to the first embodiment. The development device 20 according to the first embodiment includes a container chamber 34 containing a single-component developer, and a development chamber 35 including a development roller 21 utilized as a developer carrier carrying the single-component developer for developing the latent image on the photoreceptor 3, a supply roller 22 utilized as a supply member supplying the single-component developer to the development roller 21, with a partition 36 being provided between the container chamber 34 and the development chamber 35. The partition 36 has a mountain-like shape by which the development device 20 is divided into two sections; the container chamber 34 and the development chamber 35. The development device 20 forms a toner layer on the development roller 21, conveying the development roller 21 such that the toner layer on the development roller 21 is brought into contact with the photoreceptor 3, thereby developing the electrostatic latent image on the photoreceptor 3 (i.e., contact type single-component development). The container chamber 34 includes a stirring and conveyance member 24 stirring the toner in the development device 20 by rotation and mechanically conveying the stirred toner beyond the partition 36 to the development chamber 35 to supply the conveyed toner to the supply roller 22 utilized as a supply member. The supply roller 22 is formed of foamed polyurethane, and includes flexibility so that the supply roller 22 has a structure that can retain the toner easily with its cells having a diameter of 50 to 500 μm. Further, since the supply roller 22 has a relatively low MIS-A hardness of 10 to 30°, the supply roller 22 can be in uniform contact with the development roller 21. The supply roller 22 is rotationally driven in the same direction as the development roller 21. That is, the supply roller 22 and the development roller 21 are rotationally driven in the same directions so that they travel in opposite directions in their mutual contact regions of rollers. The linear velocity of the rollers (supply roller 22/development roller 21) preferably ranges from 0.5 to 1.5 m/s. Alternatively, the supply roller 22 is rotationally driven in the opposite direction to the development roller 21. That is, the supply roller 22 and the development roller 21 are rotationally driven in the opposite directions so that they travel in the same directions in their contact regions of rollers. Note that in the first embodiment, the supply roller 22 and development roller 21 are rotationally driven in the same directions, and the linear velocity of the supply roller 22 and development roller 21 is set at 0.9 m/s. A contact amount of the supply roller 22 with the development roller 21 is set in the range of 0.5 to 1.5 mm. In the first embodiment, if an effective unit width is 240 mm (vertical A4 size), the required torque is in a range from 14.7 to 24.5 Ncm.

The development roller 21 includes a conductive substrate and a rubber surface layer formed on the conductive substrate. The development roller 21 has a diameter in a range from 10 to 30 mm and has the surface roughness Rz of 1 to 4 μm. The preferable values for the surface roughness Rz is in a range from 13 to 80% of an average particle diameter of the toner. The development roller 21 having the surface roughness of this range can convey the toner without allowing the toner to become embedded in the surface of the development roller 21. It is particularly preferable that the surface roughness Rz of the development roller 21 be in the range of 20 to 30% of the average particle diameter of the toner, so that the surface of the development roller 21 does not retain the toner charged significantly low. Examples of the rubber material include silicone rubber, NBR (nitrile-butadiene rubber), hydrin rubber, and EPDM (ethylene-propylene terpolymer) rubber. Further, it is preferable that the surface of the development roller 21 include a coat layer for stabilizing the aging quality. Examples of materials for the coat layer include silicone type materials and Teflon (Registered Trade Mark) type materials. The silicone type materials have an excellent toner charging property whereas Teflon (Registered Trade Mark) type materials have an excellent releasability. Note that these two types of materials may contain a conductive material such as carbon black in order to exhibit conductivity. The preferable thickness of the coat layer may be in the range of 5 to 50 μm. If the thickness of the coat layer exceeds this range, the coat layer may experience damage such as cracks.

The toner having a predetermined polarity (negative-polarity in the first embodiment) on the surface of the supply roller 22 or inside the supply roller 22 is retained on the surface of the development roller 21 in the following manners: by allowing the toner to be sandwiched in the contact point between the supply roller 22 and the development roller 21 that rotate in mutually opposite directions; by allowing the toner to have electrostatic force due to a frictional charge effect; and by a conveyance effect of the surface roughness of the development roller 21. However, the toner layer of the development roller 21 may not be uniformly attached but may be excessively attached (e.g., 1 to 3 mg/cm$^2$). Thus, a restriction member 23 restricting the thickness of the toner layer is provided so as to contact the development roller 21 to form a toner thin layer having a uniform thickness on the development roller 21. An edge of the restriction member 23 is directed at the downstream side of a rotational direction of the development roller 21 and the central portion of the restriction member 23 is in contact with the toner thin layer of the development roller 21. Alternatively, the edge of the restriction member 23 may be directed at the upstream side of the rotational direction of the development roller 21 and the edge portion of the restriction member 23 may be in contact with the toner thin layer of the development roller 21.

A preferable material for the restriction member 23 may be metal such as SUS304, and its preferable thickness may be in the range of 0.1 to 0.15 mm. Apart from metal, it is also possible to use rubber materials such as polyurethane rubber having a thickness of 1 to 2 mm, or resin materials having relatively high hardness such as silicone resin. Note that the materials other than metal may also be mixed with carbon black to reduce the resistance. Accordingly, it is possible to generate an electric field between the development roller 21 and the restriction member 23 by connecting the restriction member 23 to a bias power source.

As illustrated in FIG. 4, the development device 20 includes the stirring and conveyance member 24, a detection member (rotational member) 27, and a synchronization member 26. The stirring and conveyance member 24 is provided in the container chamber 34. The stirring and conveyance member 24 rotates to stir the toner of the single-component developer in the container chamber 34 to charge the toner and to convey the charged toner to the development chamber 35. The detection member 27 is provided in the development chamber 35 to detect a remaining amount of toner, and the rotational position of the detection member 27 changes with a corresponding amount of toner remaining in the development chamber 35. The synchronization member 26 is provided near the partition 36 to time rotations of the stirring and conveyance member 24 and the detection member 27 and to transmit a driving force to the detection member 27.

Figure 5:
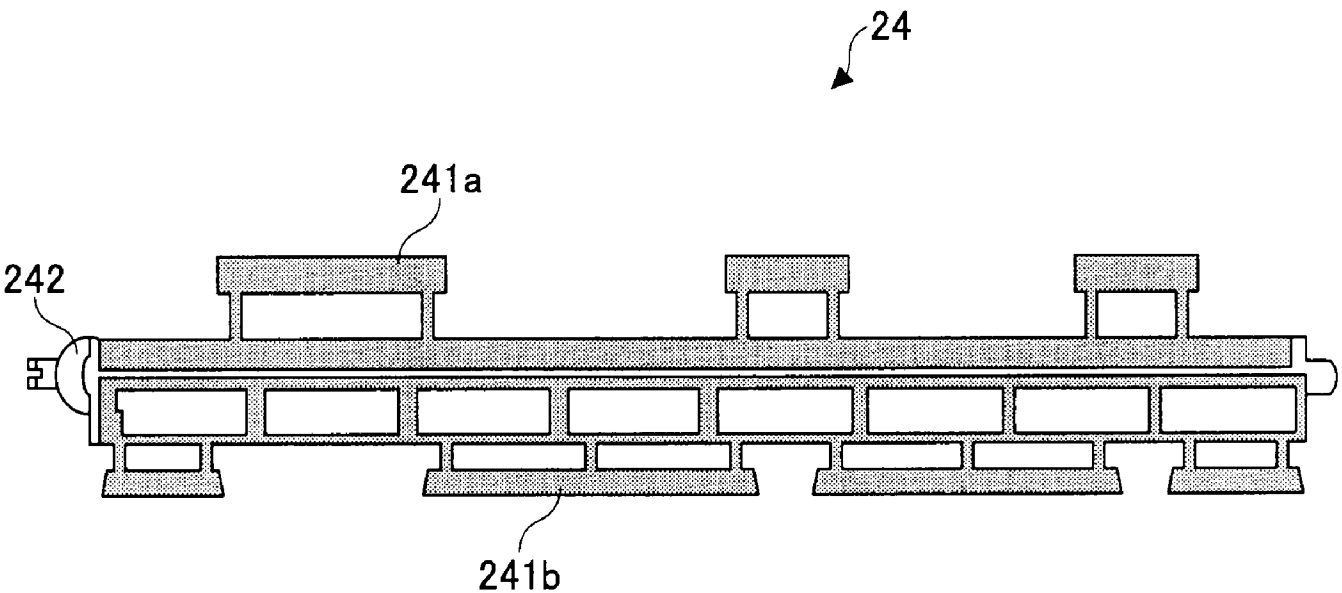
FIG. 5 is a view illustrating a shape of a stirring and conveyance member.

Next, the stirring and conveyance member 24, the detection member 27, and the synchronization member 26 are specifically described. FIG. 5 illustrates a configuration of the stirring and conveyance member 24, FIGS. 6A to 6C each illustrate a configuration of the detection member 27, and FIG. 7 and FIGS. 8A and 8B each illustrate a configuration of the synchronization member 26. FIG. 9 illustrates an assembly of the stirring and conveyance member 24, the detection member 27, and the synchronization member 26. As illustrated in FIGS. 4, 5, and 9, the stirring and conveyance member 24 includes a rotational shaft 242 and blades 241*a* and 241*b* attached to the rotational shaft 242. A cam 25 is attached to one end of the rotational shaft 242, and a disk 243 is attached to the cam 25. The rotational shaft 242 is provided in the stirring and conveyance member 24 to receive the driving force of a driving motor (not shown), thereby rotating in the direction indicated by an arrow in FIG. 4.

FIG. 5 is a view illustrating a shape of the stirring and conveyance member 24. The stirring and conveyance member 24 includes the rotational and film-like blades 241*a* and 241*b*. The stirring and conveyance member 24 has a function to friction-charge the toner by stirring the toner in the container chamber 34. The stirring and conveyance member 24 also has a function to convey the charged toner from the container chamber 34 to the development chamber 35. The blades 241*a* and 241*b* of the stirring and conveyance member 24 are asymmetrically arranged with respect to the rotational shaft 242 as a central line, so that the blades 241*a* and 241*b* have respective shapes for corresponding functions, though the functions may not be completely separated. The conveyance capability and stirring capability may be controlled by providing perforations in the blades and adjusting positions and areas of the blades. For example, the blade 241*a* utilized for the stirring function includes numerous perforations whereas the blade 241*b* utilized for the conveying function includes fewer perforations and a larger blade area than the blade 241*a* to adjust the amount of toner to be conveyed. The amount of toner to be conveyed is determined based on a consumed amount of toner for development, that is, the consumed amount of toner is determined as a subsequent amount of toner to be supplied.

Alternatively, the conveyance capability and stirring capability may be controlled by changing the length of the corresponding blades (from the rotational shaft 242 to a peripheral end of the blade). For example, the blade 241*a* for the stirring function may be formed longer than the blade 241*b* for the conveyance function to control the stirring capability of the blade 241*a*. Note that FIGS. 3 and 4 illustrate the blade 241*a* that is formed longer than the blade 241*b*. The number of blades of the stirring and conveyance member 24 is not limited to two; however, there may alternatively be three or more. If the stirring and conveyance member 24 includes plural blades, at least one of the blades is determined to include a conveyance function. As illustrated in FIG. 5, the blades 241*a* and 241*b* are formed of a resin film having flexibility. With this configuration, the blade 241*b* frictionally slides on the bottom of the enclosure 201 of the development device 20, and most of the toner contained in the container chamber 34 is conveyed to the development chamber 35. Examples of resin include olefin series resins such as polypropylene and polyethylene, fluorine series resins such as polybutylene terephthalate and polyethylene terephthalate, and silicone series resins. Note that the blades are not limited to the film-like blades, and may alternatively be plate-like blades.

As illustrated in FIG. 9, the rotational shaft 242 of the stirring and conveyance member 24 is provided with the disk 243. The disk 243 presses the synchronization member 26 against a development device enclosure 201, so that the synchronization member 26 is located based on the thickness of the disk 243. With this configuration, since variation of the synchronization member 26 in the axis direction is suppressed so as to increase rotational precision, the stirring and conveyance member 24 and the synchronization member 26 that are coaxially arranged can securely rotate and turn.

Figure 6A:
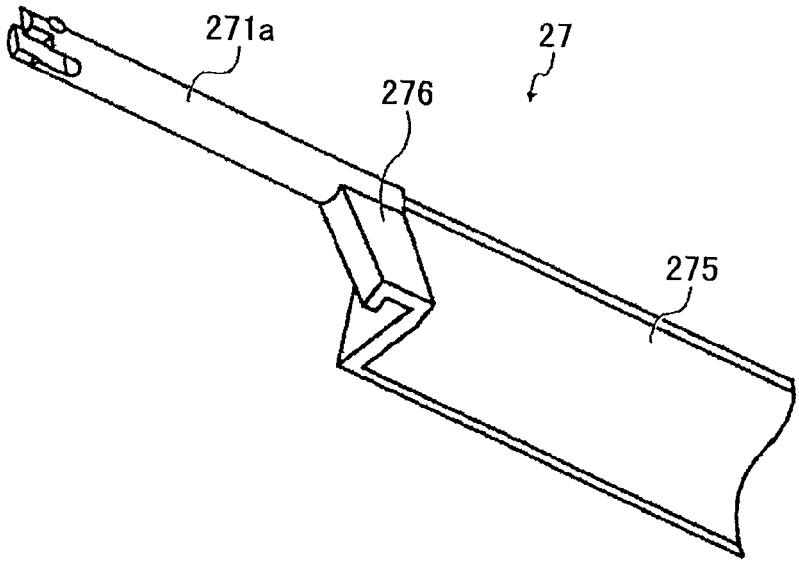
FIGS. 6A, 6B, and 6C are views each illustrating a configuration of a detection member.

As illustrated in FIG. 4, FIG. 6A, and FIG. 9, the detection member 27 includes shafts 271*a* and 271*b*, a detection plate 275, and an engaged portion 276. The detection plate 275 has a plate-like shape and is formed to make contact with the toner for detecting a remaining amount of toner. The shafts 271*a* and 271*b* are rotatably attached to the detection plate 275. The ends of the shafts 271*a* and 271*b* are provided with spring members (not shown) to bias the detection plate 275 in a downward direction in which the detection plate 275 approaches the supply roller 22. The detection plate 275 of the detection member 27 rotationally moves up and down in a space of the development chamber 35. When the detection plate 275 of the detection member 27 moves up, the detection plate 275 moves away from the supply roller 22, whereas when the detection plate 275 moves down, the detection plate 275 approaches the supply roller 22. The engaged portion 276 integrally formed the detection plate 275 is provided for one of the shafts 271*a* and 271*b*, and the lower side of the engaged portion 276 engages with a foot portion 264*a* of the synchronization member 26. The engaged portion 276 and the detection plate 275 are provided at different angles to the respective shafts 271*a* and 271*b*. The engaged portion 276 is located on the upper side of the detection member 27.

The detection plate 275 is preferably formed of a material having rigidity so that the detection plate 275 is not easily deformed. That is, if the detection plate 275 is formed of a material having flexibility that is easily deformed, the detection plate 275 may not detect a remaining amount of toner. Even if the toner is nonmagnetic single-component developer, the detection plate 275 may not detect a remaining amount of toner. Accordingly, preferable materials for the detection plate 275 include a thermoplastic resin or a thermosetting resin such as an ABS (acrylonitrile-butadiene-styrene copolymer) resin, ACS (acrylonitrile-chlorinated polyethylene-styrene) resin, vinyl monomer-olefin copolymers, phenol resin, epoxy resin, polyester resin, silicone resin, melamine resin, and alkyd resin. The above resins may contain a pigment such as carbon black, silica, and alumina as filler.

Figure 6B:
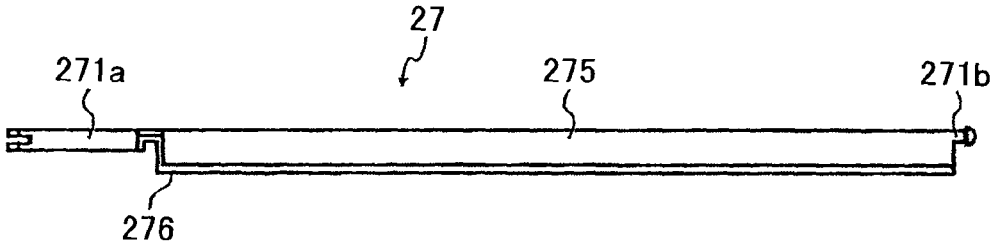
Figure 6C:
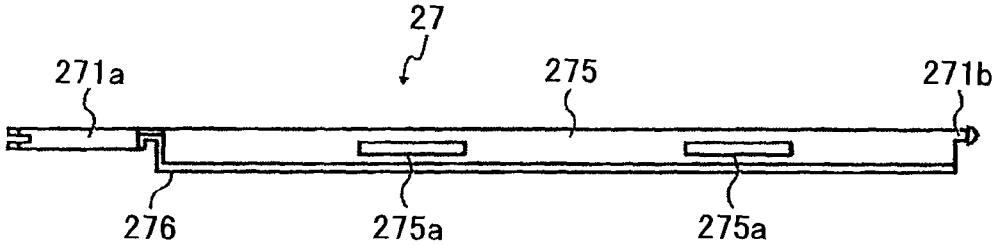
Figure 7:
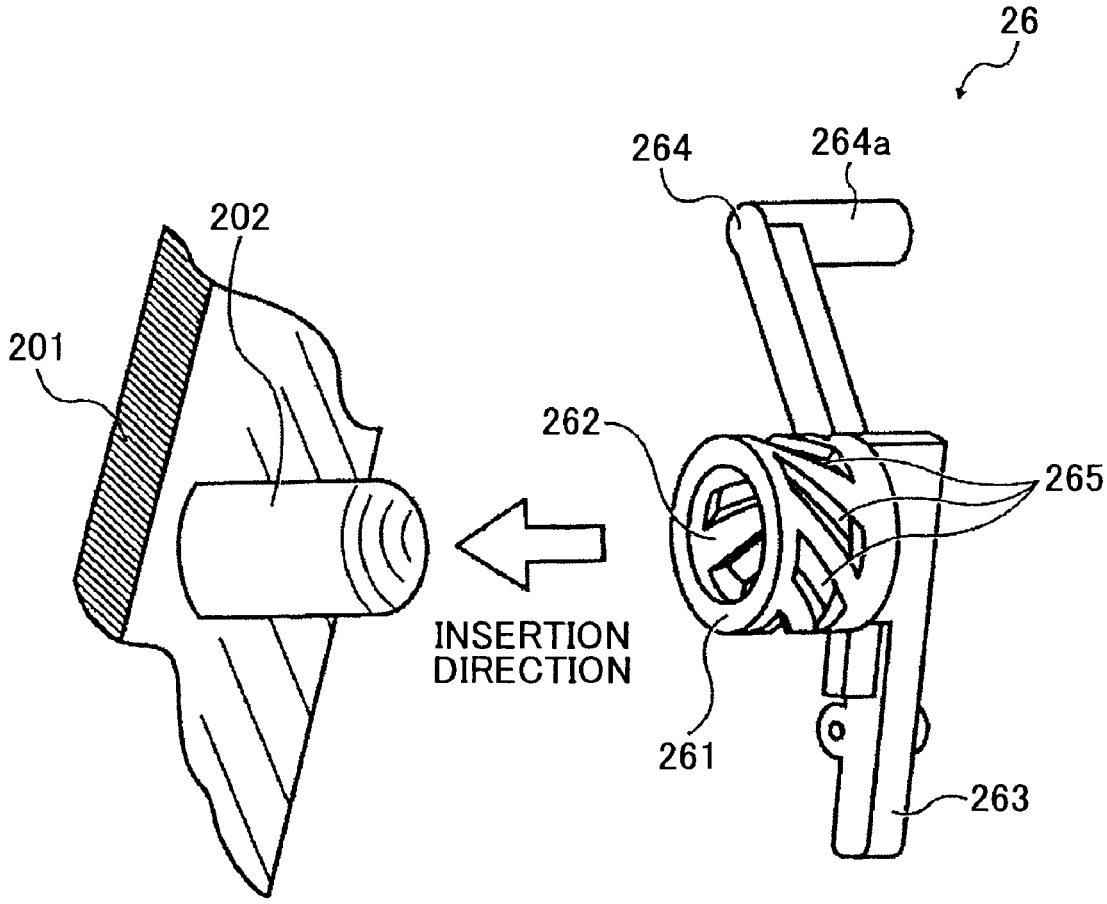
FIG. 7 is a view illustrating a configuration of a synchronization member.

A detection surface area of the detection plate 275 is in the range of 1000 to 1500 $mm^2$. It is preferable that the detection surface area be small to detect a remaining amount of toner, because the smaller detection area can detect a smaller amount of toner. Accordingly, if the detection surface area exceeds 1500 $mm^2$, detection accuracy of the remaining amount of toner decreases, due to the detection surface area of the detection plate 275 having increased force of moving the toner. By contrast, if the detection surface area is equal to or smaller than 1000 $mm^2$, the detection plate 275 may be damaged. It is also preferable that the detection plate 275 have a width from the bottom to top of 10 mm or more. The greater the width is, the smaller the amount of remaining toner that can be detected. Accordingly, the detection accuracy of the remaining amount of toner can be increased. However, if the detection plate 275 is too long, load applied on the detection plate 275 increases, and thus, the detection plate 275 may be damaged. Moreover, it may be difficult to reduce the size of the development device 20. As illustrated in FIG. 6C, the detection plate 275 may include openings. In FIG. 6C, two slit-like openings 275*a* are provided along the longitudinal (axial) direction of the detection plate 275 and also at the center in a width direction of the detection plate 275.

As illustrated in FIGS. 4, 7, 8A and 8B, and 9, a shaft of a cylindrical portion 261 includes a first lever 263 and a second lever 264. The first lever 263 is brought into contact with the cam 25 that is coaxially arranged with the stirring and conveyor member 24. The second lever 264 includes the foot portion 264*a*, which is engaged with the engaged portion 276 of the detection member 27. The cylindrical portion 261 includes a shaft hole 262 one end of which is closed, and into which a shaft projection portion 202 provided in the enclosure 201 is inserted. With this configuration, the synchronization member 26 is rotatably attached. As illustrated in FIG. 9, the cylindrical portion 261 of the shaft end of the synchronization member 26 includes a spring member 266, so that the synchronization member 26 is biased in the direction in which the first lever 263 is brought into contact with the cam 25.

Figure 8A:
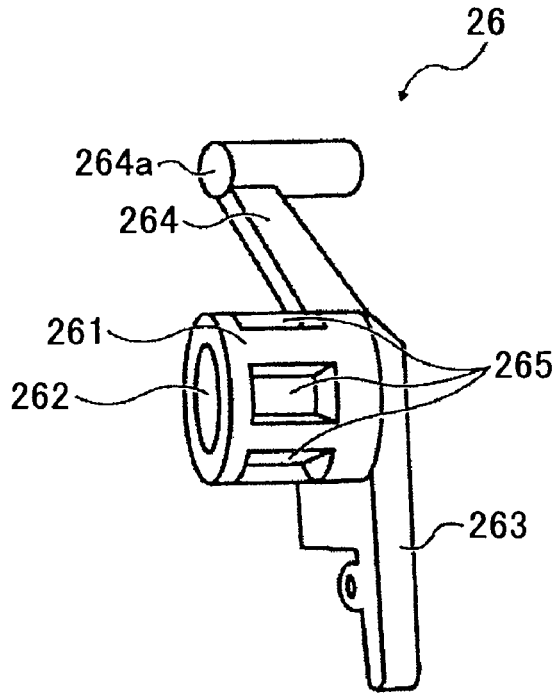
FIGS. 8A and 8B are views illustrating respective shapes of the synchronization member having the opening.
Figure 8B:
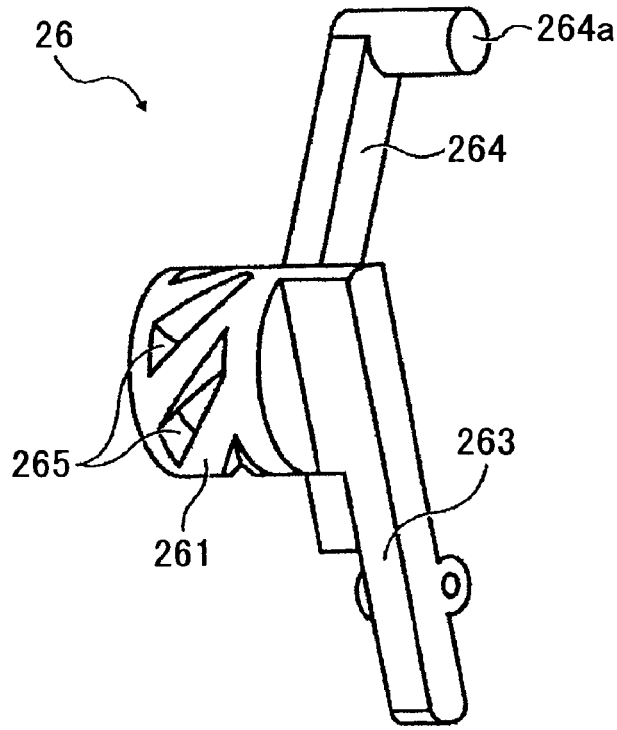
Figure 9:
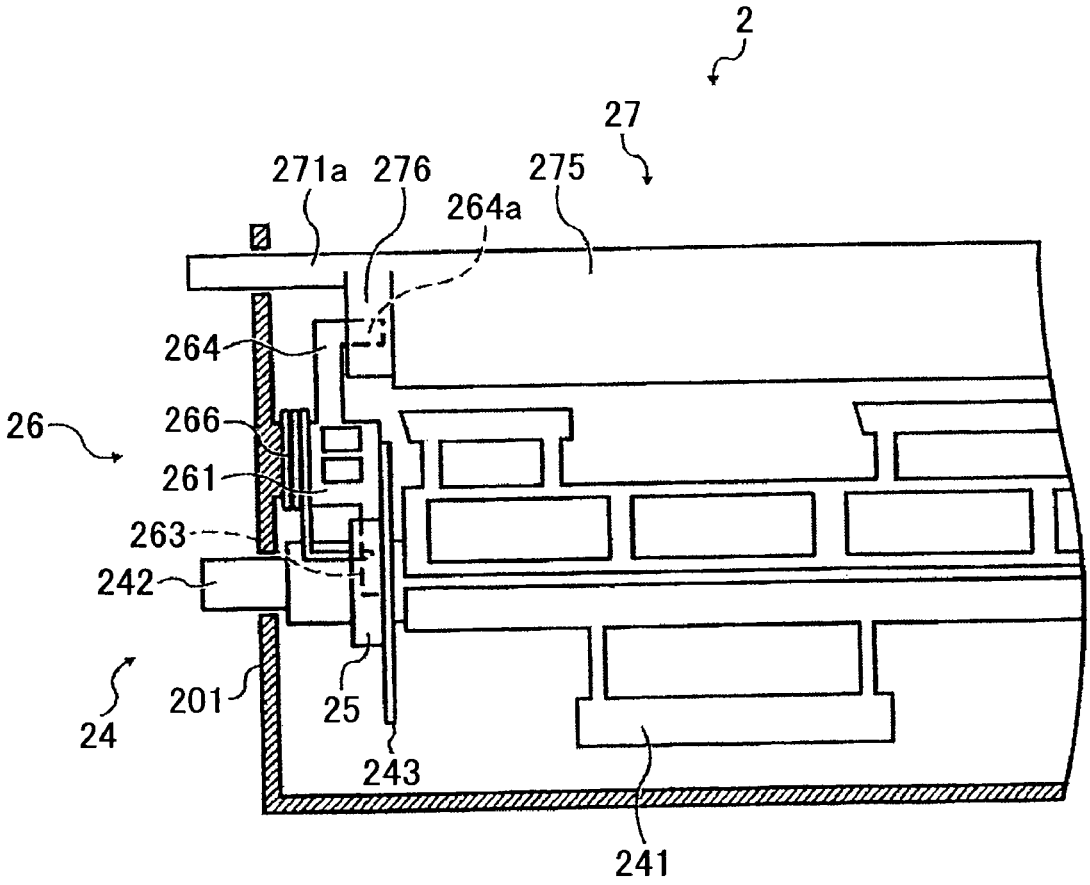
FIG. 9 is a view illustrating an assembly of the stirring and conveyance member, the synchronization member, and the detection member.

FIGS. 8A and 8B illustrate views in which the cylindrical portion 261 of the synchronization member 26 includes openings 265 communicating with the shaft hole 262. The openings 265 are provided in the cylindrical portion 261 of the synchronization member 26 according to the following reason. Since the development device 20 contains the toner, the toner may enter between the shaft hole 262 of the rotating synchronization member 26 and projection portion 202. When the toner enters between the shaft hole 262 of the synchronization member 26 and the projection portion 202, the toner is melted due to friction heat generated by rotational sliding of the synchronization member 26. When the melted toner is cooled to be solidified, the solidified toner fixates the synchronization member 26 and the projection portion 202. As a result, the synchronization member 26 may be unable to convey the toner and also unable to detect the remaining amount of toner. Thus, if the synchronization member 26 is used for a long time, the synchronization member 26 is fixated by the solidified toner and becomes unable to operate properly. FIGS. 8A and 8B illustrate views in which the synchronization member 26 includes the openings 265 to control such drawbacks. As illustrated in FIGS. 8A and 8B, the cylindrical portion 261 of the synchronization member 26 includes such openings 265.

By providing the openings 265 in the cylindrical portion 261 of the synchronization member 26, the toner having entered in the shaft hole 262 can be discharged. With this configuration, the toner is prevented from remaining in the shaft hole 262, and the projection portion 202 and the synchronization member 26 can be prevented from being fixated due to the fact that the toner is melted and solidified in the shaft hole 262. FIG. 8A illustrates a case where the openings 265 include rectangular shaped holes, whereas FIG. 8B illustrates a case where the openings include spiral shaped holes. As illustrated in FIG. 8B, since the synchronization member 26 includes the spiral shaped openings in the rotational direction, the toner having entered between the shaft hole 262 of the synchronization member 26 and the projection portion 202 can be immediately discharged, thereby preventing the projection portion 202 and the synchronization member 26 from being fixated.

With this configuration, the stirring and conveyor member 24 rotates in the direction indicated by the arrow in FIG. 4 by receiving the driving force from the driving motor (not shown). Accordingly, the stirring and conveyor member 24 frictionally slides, while stirring the toner of the single-component developer, on the bottom of the enclosure of the container chamber 34 with the blades 241*a* and 241*b*, to supply the toner from the container chamber 34 to the development chamber 35. The stirring and conveyor member 24 conveys the toner beyond the partition 36 to the development chamber 35 in this manner.

The detection member 27 is driven by the driving force from the stirring and conveyor member 24 transmitted via the synchronization member 26. The remaining amount of toner is thus detected while timing the conveyance operation of the stirring and conveyor member 24. Further, since the toner having entered is discharged from the shaft hole 262 of the rotating synchronization member 26, the remaining amount of toner, including the amount when the toner is almost finished (hereinafter also called a "first toner-near-end"), can be stably detected over a long period of time. When detecting the remaining amount of toner or the first toner-near-end, the first lever 263 of the synchronization member 26 is in pressure-contact with the cam 25 coaxially arranged with the stirring and conveyor member 24, and the synchronization member 26 is driven by the stirring and conveyor member 24 via the cam 25. Accordingly, the movement of the synchronization member 26 fluctuates along the shape of the cam 25. The lower side of the engaged portion 276 of the detection member 27 is engaged with the foot portion 264*a* of the second lever 264 of the synchronization member 26 by pressure contact. The detection member 27 is thus rotated in accordance with the movement of the synchronization member 26. Specifically, the detection member 27 is lifted by the second lever 264 of the synchronization member 26, and pulled down by the bias force in a downward direction of the detection member 27. The detection member 27 is moved downward until the downward motion of the detection member 27 is stopped by the second lever 264. The synchronization member 26 transmits the driving force to the detection member 27 to be raised and also restricts the lowermost position of the detection member 27. The second lever 264 at its lowermost position does not contact the partition 36 when the synchronization member 26 is moving.

In the first embodiment, a predetermined angle is formed between the engaged portion 276 and the detection plate 275 of the detection member 27 such that the engaged portion 276 is located above the detection plate 275. With this configuration, the detection plate 275 at the lowermost position can sufficiently approach the supply roller 22 to detect the first toner-near-end despite the fact that the second lever 264 at the lowermost position is not in contact with the partition 36. Thus, defining the first toner-near-end in accordance with how much toner remains in the development chamber 35 can be changed by altering the positional angle between the detection plate 275 and the engaged portion 276.

The detection of the first toner-near-end (hereinafter also called a "first toner-near-end detection") is described below. As illustrated in FIG. 4, the detection plate 275 of the detection member 27 detecting the remaining amount of toner changes the angle of rotation, that is, its lowermost position while rotation in accordance with an amount of toner. As described above, the detection plate 275 rotates in a direction toward the supply roller 22. If the development chamber 35 of the development device 20 contains too much toner, the rotation of the detection plate 275 is stopped due to the toner having entered between the detection plate 275 and the supply roller 22. Accordingly, the angle of the rotation of the detection plate 275 is decreased, and the detection plate 275 stops rotating at a position distant from the supply roller 22 (i.e., the detection plate 275 stops at positions indicated by broken lines in FIG. 4). If the development chamber 35 contains little toner, the angle of the rotation of the detection plate 275 is increased. Accordingly, the detection plate 275 comes close to the supply roller 22 or comes to a position almost in contact with the supply roller 22 by rotation (i.e., the detection plate 275 comes to positions indicated by solid lines in FIG. 4). Thus, the remaining amount of toner of the development device 20 can be detected by detection of the angle of rotation of the detection plate 275, that is, detection of the lowermost position of the detection plate 275 while rotating.

Figure 10A:
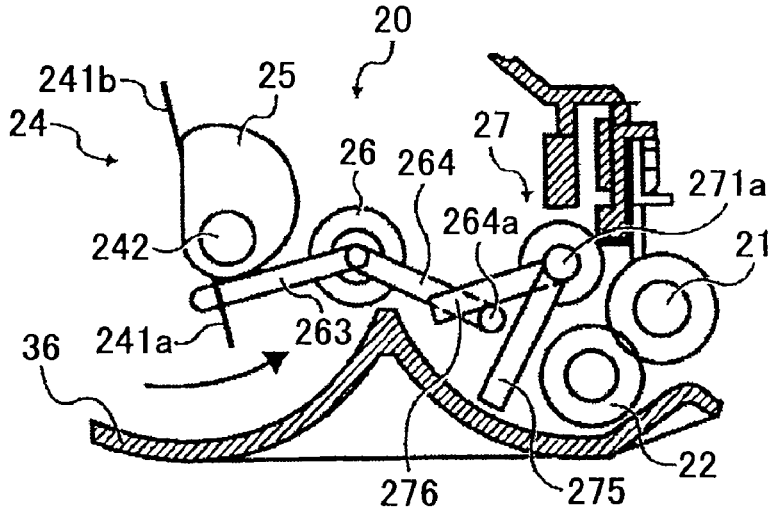
FIGS. 10A, 10B, 10C, and 10D are views illustrating synchronized movements of the stirring and conveyance member, the synchronization member, and the detection member.

Next, the timing to stir and convey the toner and to detect the amount of toner in the development device 20 are described below with reference to FIGS. 10A to 10D. Note that as illustrated FIGS. 10A to 10D, the stirring and conveyor member 24 according to the first embodiment includes two blades having respective functions, where the blade 241*a* having a stirring function is longer than the blade 241*b* having a conveyance function. As illustrated in FIG. 10A, on receiving a signal to supply the toner (toner supply signal) or a signal to operate to form an image (image forming operation), the stirring and conveyor member 24 starts rotating in a direction indicated by an arrow. The cam 25 attached to the rotational shaft 242 rotates in synchronization with the rotation of the stirring and conveyor member 24. The first lever 263 of the synchronization member 26 is brought into contact with the cam 25 by the force applied from the spring member 266 (see FIG. 9).

As illustrated in FIG. 10A, since the contact position of the first lever with the cam 25 is the closest to the rotational shaft 242, the second lever 264 is located at the lowermost position. The detection plate 275 of the detection member 27 is rotated in a downward direction by downward bias generated from the spring member. However, since the second lever 264 is located at the lowermost position, the detection plate 275, until it reaches the lowermost position, is not interrupted by the second lever 264. Accordingly, if the amount of toner is small, the detection plate 275 rotates down to the position where the detection plate 275 is stopped by the toner, or the detection plate 275 rotates down to the lowermost position where the detection plate 275 is stopped by the second lever 264. FIG. 10A illustrates the position of the detection plate 275 in a case where the amount of toner is small. In this case, the detection plate 275 of the detection member 27 is placed at a lower position of the development chamber 35 so that the development chamber 35 is closed by the detection plate 275.

Figure 10B:
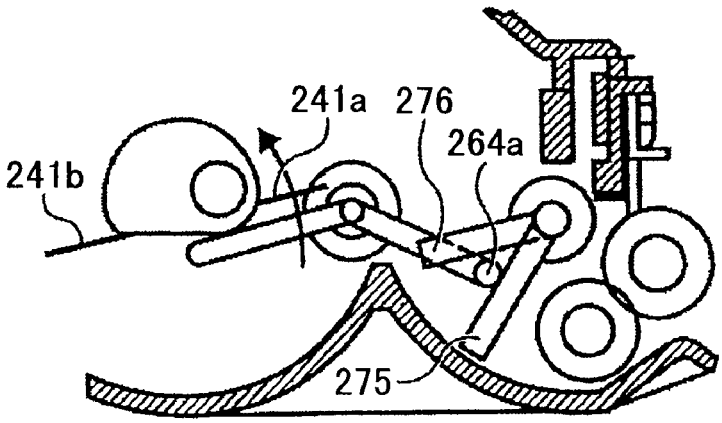

Next, FIG. 10B illustrates a state where the stirring and conveyor member 24 and the cam 25 are rotated. Since the contact position of the first lever 263 with the cam 25 is still the closest to the rotational shaft 242, the positions of the second lever 264 and the detection plate 275 remain unchanged. Thus, the development chamber 35 is still closed by the detection plate 275 of the detection member 27.

When the stirring and conveyor member 24 in the position shown in FIG. 10A rotates so that the stirring and conveyor member 24 is in the position shown in FIG. 10B, the blade 241*a* of the stirring and conveyor member 24 pushes the toner in a direction toward the development chamber 35 while it is passing near the partition 36. However, since the function of the blade 241*a* is stirring, the development chamber 35 closed by the detection plate 275 of the detection member 27 causes no adverse effect. Note that in the stirring and conveyor member 24 illustrated in FIG. 10A, if the amount of toner is large, the edge of the detection plate 275 of detection member 27 is located at a position higher than the partition 36 between the container chamber 34 and the development chamber 35. Accordingly, the development chamber 35 is open (not closed by the detection plate 275 of detection member 27).

Figure 10C:
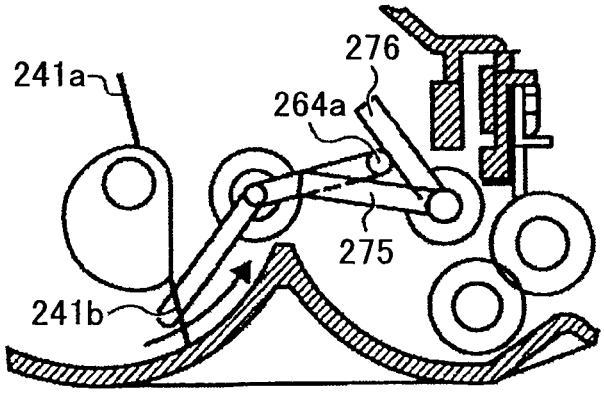

When the stirring and conveyor member 24 in the position shown in FIG. 10B rotates so that the stirring and conveyor member 24 is in the position state shown in FIG. 10C, the contact position of the first lever 263 with the cam 25 gradually moves from the position near the rotational shaft 242 to a position distant from the rotational shaft 242. Since the first lever 263 is pushed down to a position most distant from the rotational shaft 242, the second lever 264 moves from the lowermost position to the uppermost position. The detection plate 275 of the detection member 27 is biased in a downward direction with the spring member. Accordingly, when the second lever 264 moves from the lowermost position to the uppermost position, the detection plate 275 is lifted up to the uppermost position. The edge of the detection plate 275 of detection member 27 is located at a position higher than the partition 36 between the container chamber 34 and the development chamber 35. Accordingly, the development chamber 35 is open (not closed by the detection plate 275 of detection member 27).

FIG. 10C illustrates a state where the stirring and conveyor member 24 and the cam 25 are rotated. Since the contact position of the first lever 263 with the cam 25 is still the most distant from the rotational shaft 242, the positions of the second lever 264 and the detection plate 275 remain unchanged. Thus, the development chamber 35 is still open (not closed by the detection plate 275 of the detection member 27).

Figure 10D:
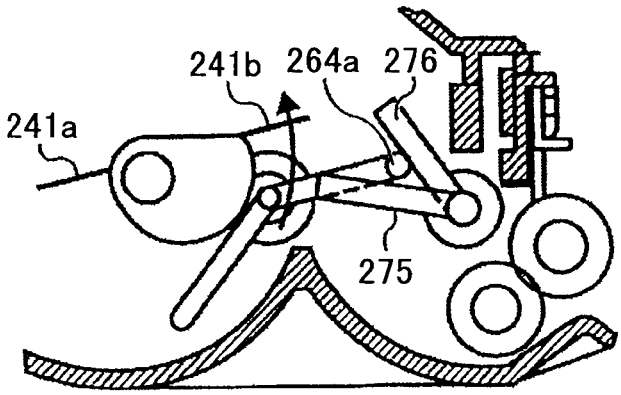

When the stirring and conveyor member 24 in the position shown in FIG. 10C rotates so that the stirring and conveyor member 24 is in the position shown in FIG. 10D, the blade 241*b* of the stirring and conveyor member 24 passes near the partition 36 while pushing the toner in the direction toward the development chamber 35. The function of the blade 241*b* includes conveying, so that the blade 241*b* conveys the toner to the opening of the development chamber 35. When the stirring and conveyor member 24 in the position shown in FIG. 10D rotates so that the stirring and conveyor member 24 is in the state shown in FIG. 10A, operations are carried out reverse to the operations carried out when the stirring and conveyor member 24 in the position shown in FIG. 10B rotates so that the stirring and conveyor member 24 is in the position shown in FIG. 10C, thereby returning the stirring and conveyor member 24 in the state shown in FIG. 10A.

The first toner-near-end detection is carried out where the second lever 264 is located at the lowermost position and the detection plate 275 is not interrupted by the second lever 264 until the detection plate 275 rotationally moves to the lowermost portion; that is, the first toner-near-end detection is carried out approximately at the timing of the states shown in FIG. 10A and FIG. 10B. At this timing, the first toner-near-end detection experiences less adverse effect from the conveyance of the toner.

In the development device 20 according to the first embodiment, since the synchronization member 26 biased by the spring member 266 is brought into contact with the cam 25 attached to the rotational shaft 242 of the stirring and conveyor member 24, the synchronization member 26 can be rotated without applying other driving forces. Accordingly, the toner is conveyed and supplied to the development chamber 35 while the synchronization member 26 controls the motion of the detection member 27 to detect the remaining amount of toner.

Figure 11:
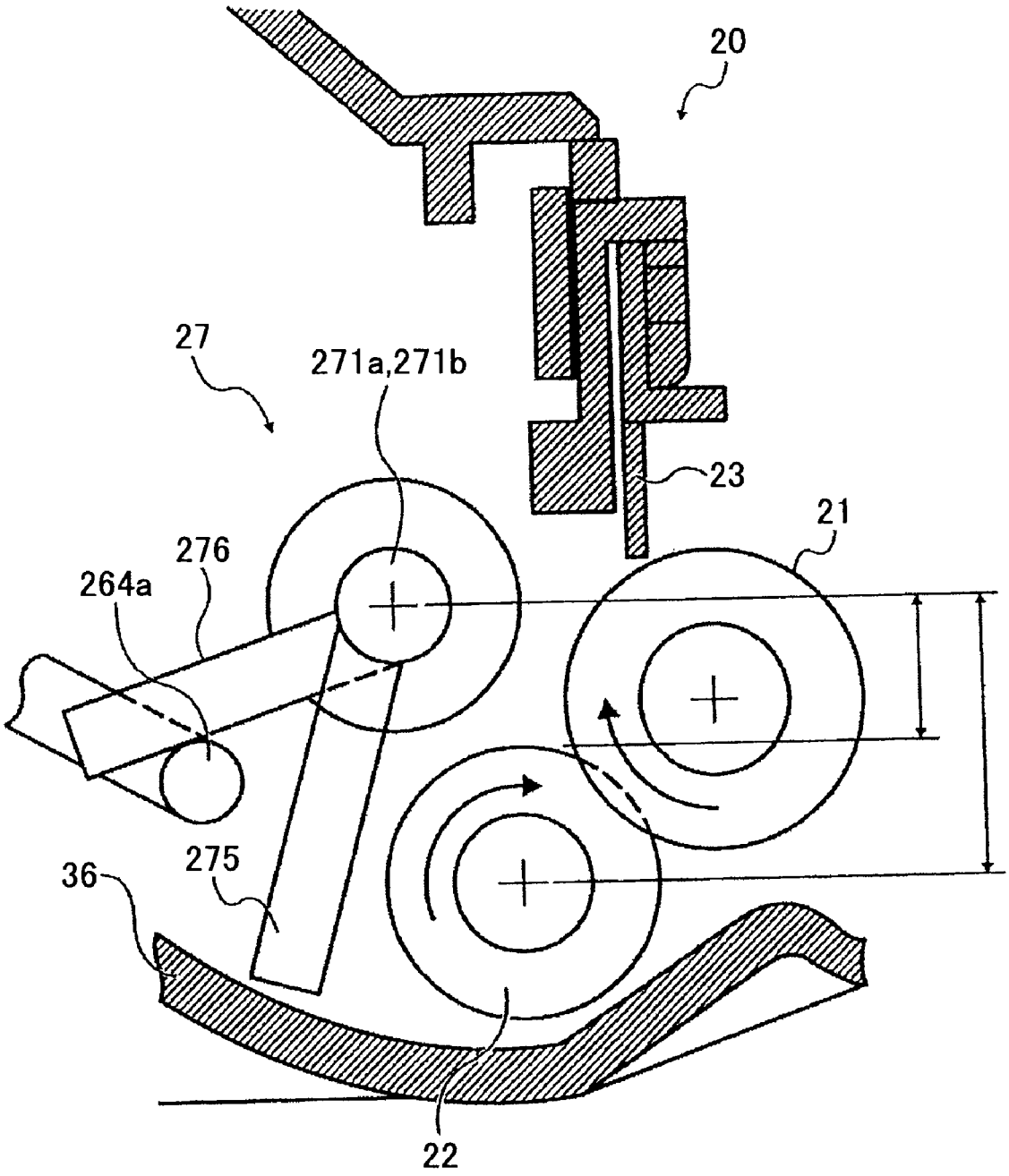
FIG. 11 is a diagram illustrating a positional relationship between the detection member and other members.

FIG. 11 is a diagram illustrating a positional relationship between the detection member 27 and other members. As illustrated in FIG. 11, the detection member 27 is located such that a central point of the rotational shafts 271 (i.e., 271*a* and 271*b*) is located at a position higher than a contact region between the supply member 22 and the development roller 21. At this contact region, the toner is supplied from the supply member 22 to the development roller 21. The accuracy in the detection of the remaining amount of toner may be improved by locating the central point of the rotational shaft 271 at the position higher than a contact region between the supply member 22 and the development roller 21. Further, the detection member 27 is located such that the central point of the rotational shafts 271 (i.e., 271*a* and 271*b*) is located higher than a central position of the rotational shafts of the supply member 22. The supply member 22 supplies the single-component developer from the development chamber 35 to the development roller 21 such that little toner remains in the development chamber 35. Accordingly, the supply member 22 rotates to frictionally slide or almost frictionally slide on the bottom of the enclosure of the development chamber 35. However, if the central position of the rotational shafts 271*a* and 272*b* of the detection member 27 is located at a position lower than the supply member 22, it is difficult to increase the width of the detection member 27.

Figure 12:
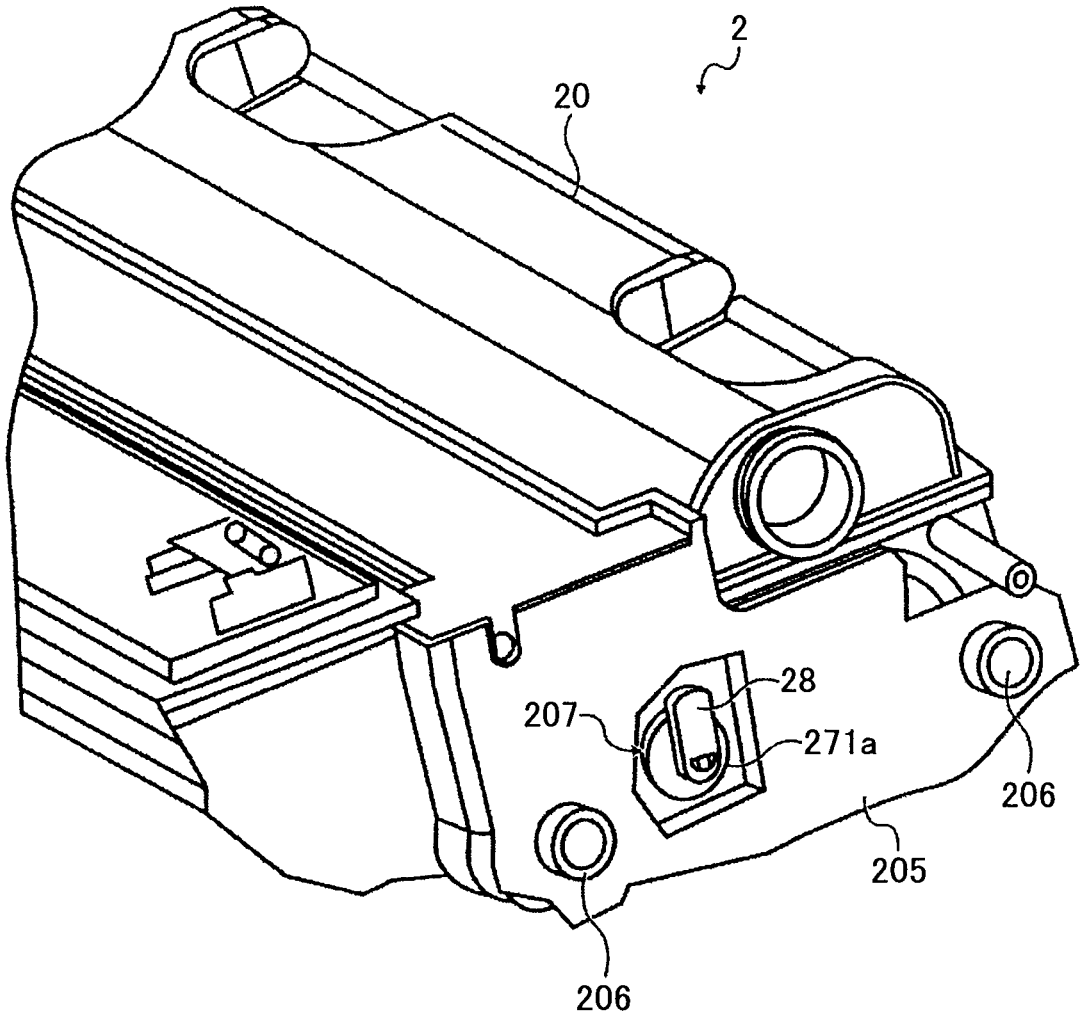
FIG. 12 is a view illustrating openings provided in peripheral surfaces of the process unit.

Next, a configuration of the image forming apparatus according to the first embodiment in which the first toner-near-end is detected by rotation of the detection member 27 is described. The shaft 271*a* of the detection member 27 illustrated in FIGS. 6A to 6C is provided with an arm 28 illustrated in FIG. 12. FIG. 12 is a diagram partially illustrating an external configuration of the process unit 2.

The process unit 2 includes a process unit enclosure 205. An opening portion 207 is formed in one side of the enclosure 205 such that the arm 28 can be rotated in an area of the opening portion 207. The arm 28 is exposed from the opening portion 207. An end surface of the rotational shaft 271*a* of the detection member 27 and an external surface of the arm 28 are aligned with an external surface of the enclosure 205. With this configuration, the arm 28 and the rotational shaft 271*a* do not externally project from the enclosure 205. Thus, the process unit 2 can be easily removed from the image forming apparatus 1. Moreover, the process unit 2 can be easily attached to a rotational member 29 (see FIGS. 15 to 17). Round guides 206 are formed on corresponding sides of the enclosure 205. When the process unit 2 is attached or in a process of being attached to the image forming apparatus 1, the guides 206 are in contact with surfaces of a main body wall 101 and guide rails 102 (see FIGS. 16A and 16B) to support the process unit 2.

Figure 13A:
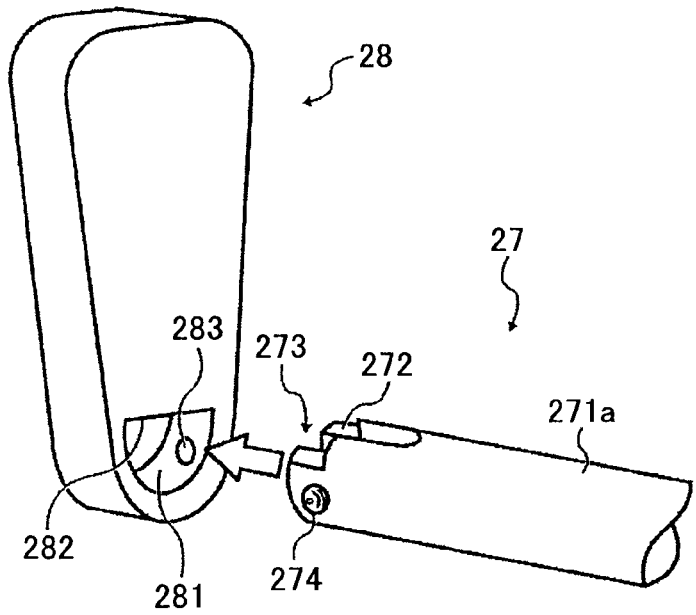
FIGS. 13A and 13B are diagrams illustrating connection portions of a shaft of the detection member and an arm.
Figure 13B:
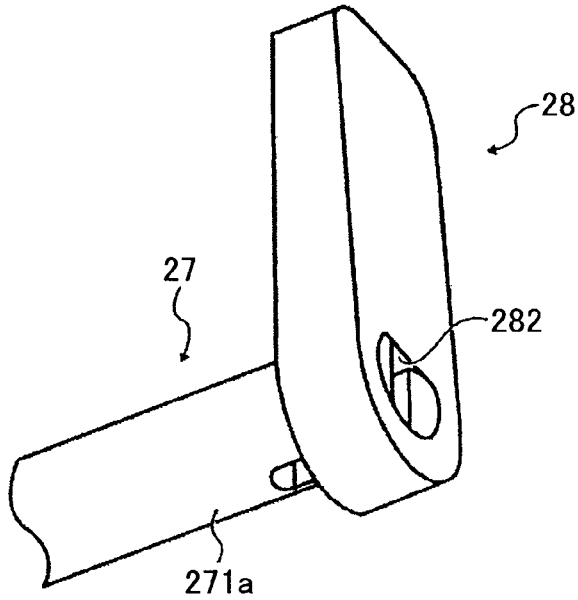

FIGS. 13A and 13B illustrate a connection part between the shaft 271*a* of the detection member 27 and the arm 28. Flat portions 272 are formed in an end of the shaft 271*a* of the detection member 27 by cutting part of the round shaft, and a groove is formed in the shaft 271*a* by cutting the central portion of a round end surface to the outer peripheral surface of the shaft 271*a*. Further, a pair of projections 274 is provided on the outer peripheral surface of the shaft 271*a*. The arm 28 has a plate-like shape of an approximately rectangular shape. The arm 28 includes a shaft hole 281 at one end into which the shaft 271*a* is inserted. The shaft hole 281 includes a flat surface 282 formed corresponding to the flat portion 272 of the shaft 271*a*. A pair of semispherical recess portions 283 is formed in an inner surface of the shaft hole 281 such that the projections 274 are fit in the semispherical recess portions 283. The flat portions 272 of the shaft 271*a* are formed to have approximately the same length as a thickness of the arm 28, and the length of the groove 273 is longer than the thickness of the arm 28. With this configuration, the edge of the shaft 271*a* of the detection member 27 can simply and easily be fitted in the shaft hole 281 of the arm 28. Since the flat portions 272 and 282 are mutually in contact and the projections 274 are fitted in the recess portions 283, the shaft 271*a* does not move in its rotational direction. Further, since the groove 273 is formed in the shaft 271*a*, the shaft 271*a* of the detection member 27 is resiliently fitted into the shaft hole 281 of the arm 28.

Figure 14:
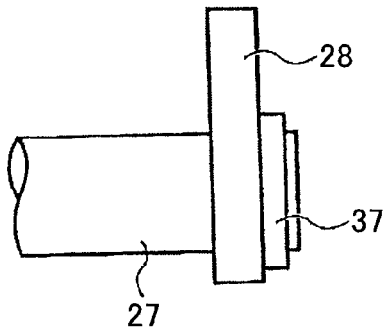
FIG. 14 is a diagram illustrating a connection portion of a shaft of a detection member and an arm according to the related art.

FIG. 14 is a diagram illustrating a coupling portion of a shaft of a detection member and an arm according to the related art. According to the related art, the shaft 27 of the detection member externally projects from the end of the arm 28, and a C-ring or E-ring is attached to the projected portion of the shaft 27 to prevent the shaft 271*a* from coming off from the arm 28. However, with this related art configuration, the projected portion of the shaft 271*a* may require extra space, so that it may be difficult to reduce the size of the process unit. Further, attaching a C-ring or an E-ring may also require extra time.

According to the first embodiment, the arm 28 can be easily attached to the shaft 271*a* of the detection member without need for attaching screws or welding. Further, since there is no external projected portion from the end of the arm 28, it is easy to reduce the size of the process unit 2. As described above, the rotation of the detection member 27 is transmitted to the main body of the image forming apparatus 1 via the arm 28 attached to the shaft 271*a* of the detection member 27. Accordingly, in the image forming apparatus 1, the remaining amount of toner in the development device 20 can be detected by detecting the lowermost position of the rotating detection member 27.

Figure 15:
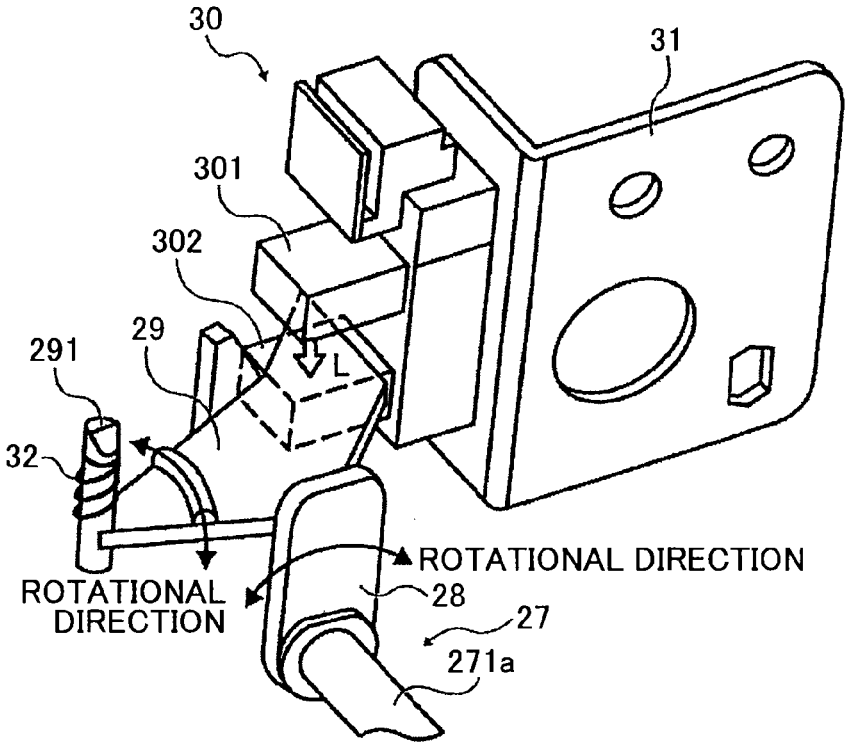
FIG. 15 is a view illustrating a process of an operation of a first toner-near-end detected in the order of the detection member, the arm, the detection member, and the sensor.

FIG. 15 illustrates a configuration of the main body of the image forming apparatus 1 that detects the first toner-near-end. The main body of the image forming apparatus 1 includes a rotational member 29 rotating corresponding to the rotation of the arm 28 that is attached to the shaft 271*a* of the detection member 27 in the development device 20, and an optical sensor 30 detecting the rotation of the rotational member 29.

The rotational member 29 includes a plate-like shape and is attached to a rotational shaft 291, so that the rotational member 29 can rotate in a horizontal direction, and is also biased toward the arm 28 with a spring 32. The shape of a surface in contact with the arm 28 of the rotational member 29 changes corresponds to a rotational position of the arm 28 such that the shape of the contact surface changes a rotation angle of the rotational member 29.

The optical sensor 30 is an optically-transparent sensor that includes a light-emitting device 301 at an upper side of the main body and a light-receiving device 302 at a lower side. The optical sensor 30 having the light-emitting device 301 and the light-receiving device 302 is attached to the enclosure (not shown) of the image forming apparatus 1 with brackets. While the rotational member 29 rotates, a portion of the rotational member 29 cuts across an intersection between the light-emitting device 301 and the light-receiving device 302 to detect the rotation of the detection member 27.

The remaining amount of toner is detected in the following manner. The arm 28 is coaxially attached to the rotational shaft 271*a* of the detection member 27, and arranged such that the arm 28 is exposed from the development device 20. When the arm 28 is rotated, the rotation of the arm 28 is transmitted to the rotational member 29. If some amount of toner remains in the development device 20, the rotation angle of the arm 28 is small. Accordingly, the rotation angle of the rotational member 29 is also small. On the other hand, if no toner remains in the development device 20, the rotation angle is large. Accordingly, the rotational member 29 rotates by a large angle. While the rotational member 29 rotates by a large angle, a portion of the rotational member 29 cuts across the sensor 30. When light emitted from the light-emitting device 301 located at the upper side of the optical sensor 30 does not reach the lower side light-receiving device 302 located at the lower side, the remaining amount of toner in the development chamber 35 can be detected. That is, a first toner-near-end can be detected as a first threshold. Alternatively, the first toner-near-end can be detected by directly detecting the rotational angle or the arm 28 without having the rotational member 29.

Figure 16A:
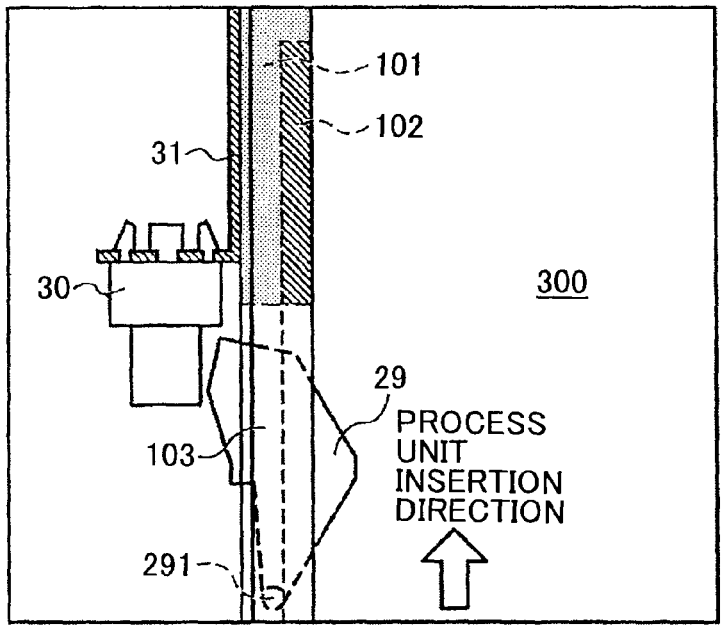
FIGS. 16A and 16B are diagrams illustrating a process in which the process unit is attached to a main body of the image forming apparatus according to the first embodiment of the invention.
Figure 16B:
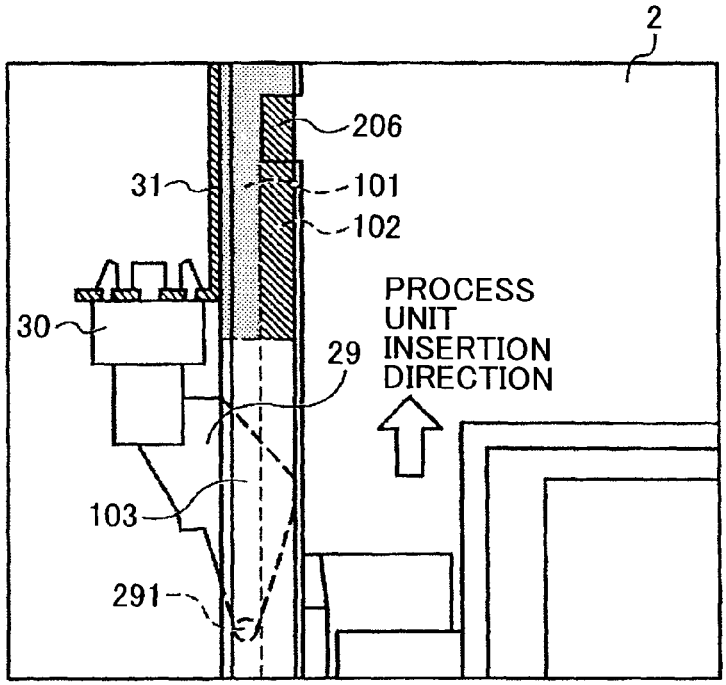
Figure 17:
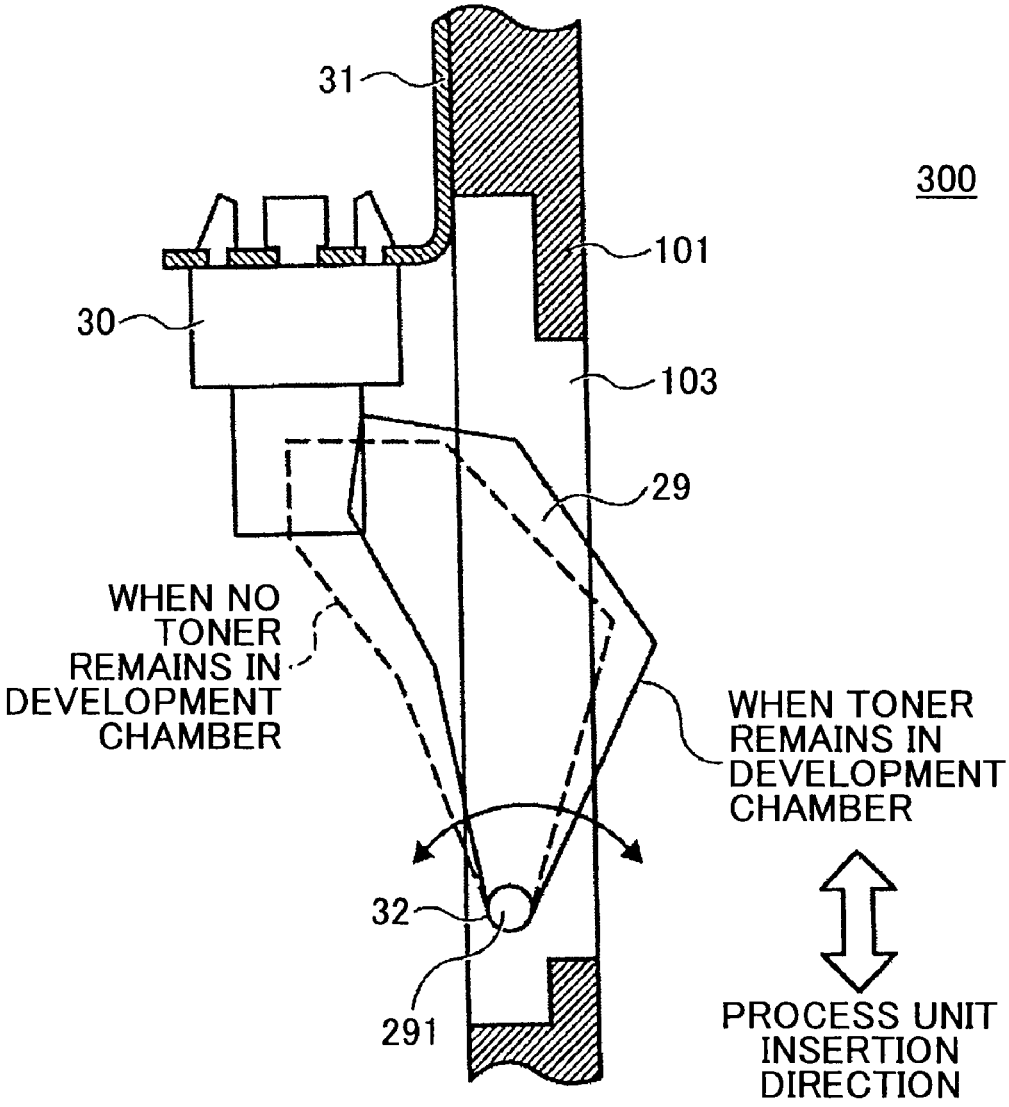
FIG. 17 is a plan view of the detection member.

FIGS. 16A and 16B are diagrams illustrating a process in which the process unit 2 is attached to the main body of the image forming apparatus 1 according to the first embodiment. FIG. 17 is a partially enlarged view of FIGS. 16A and 16B. FIG. 16A illustrates the rotational member 29 and the like in a case in which the process unit 2 is not attached to the main body of the image forming apparatus 1, whereas FIG. 16B illustrates those in which the process unit 2 is attached to the main body of the image forming apparatus 1.

As illustrated in FIGS. 16A and 16B, and FIG. 17, space 300 provided for the process unit 2 to be attached to the main body of the image forming apparatus 1 is sandwiched between sidewalls 101 of the main body of the image forming apparatus 1. An external cover (not shown) is placed outside of the sidewalls 101 of the image forming apparatus 1. The sidewalls 101 include guiderails 102 that guide the process unit 2 in the process of insertion and support the process unit 2 in the process of attachment. One of the sidewalls 101 includes an opening portion 103 in a moving area of the rotational member 29, and the rotational member 29 is attached to the opening portion 103. The rotational member 29 can be rotated in a horizontal direction, and the rotational shaft 291 is attached to the main body of the image forming apparatus 1 such that the rotational shaft 291 is located in front of the process unit 2 that is about to be inserted to the main body of the image forming apparatus 1 in an insertion direction of the process unit 2 shown by an upward thick arrow in FIGS. 16A and 16B.

The optical sensor 30 sensing the first toner-near-end is attached to the sidewall 101 with the brackets located outside of the opening portion 103 formed in the sidewall 101. The rotational member 29 is, as illustrated in FIG. 17, biased in a direction toward the space 300 by the spring 32. In a case where the process unit 2 is not attached to the image forming apparatus 1, an end of the rotational member 29 partially comes inside the space 300 and the rotational member 29 does not cut off a light beam generated from the optical sensor 30 attached outside of the sidewall 101.

With this configuration, the process unit 2 to be attached is inserted in a direction shown by an up and down thick arrow along the guiderails 102. At this stage, the rotational member 29 is in contact with an outer surface of the arm 28, and rotates a little in a direction toward the optical sensor 30 located outside of the sidewall 101 based on the rotational shaft 291 as a center of rotation. The rotational member 29 is located such that the rotational member 29 does not cut off a light beam of the optical sensor 30 if the amount of toner is not the first toner-near-end status. Note that the shape and positional relationship of the rotational member 29 may be changed such that the rotational member 29 slightly cuts off the light beam of the optical sensor 30. In this case, whether the detection (cut off of the light beam) indicates attachment of the process unit 2 or the toner-near end may be discriminated by adjusting the threshold of the first toner-near-end detection (first threshold).

FIG. 16B illustrates the rotational member 29 and the like in a case in which the process unit 2 is attached to the main body of the image forming apparatus 1. The position of the rotational member 29 in FIG. 16B indicates the first toner-near-end status. In the first toner-near-end status, the rotational member 29 further rotates such that the rotational member 29 goes beyond the position at which the process unit 2 is attached to the main body of the image forming apparatus 1. Accordingly, the rotational member 29 completely cuts off the light beam of the optical sensor 30 to thereby detect the first toner-near-end.

If the rotational member 29 is located in a direction not easily rotated in the same direction as the insertion direction of the process unit 2, for example, the rotational member 29 is located in a direction against the insertion direction of the process unit 2 (i.e., opposite direction to the insertion direction of the process unit 2), the rotational member 29 resists the insertion of the process unit 2. Accordingly, the process unit 2 may not be easily attached to the main body of the image forming apparatus 1. However, according to the first embodiment, the rotational shaft 291 of the rotational member 29 is located in front of the process unit 2 when the process unit 2 is about to be inserted in the image forming apparatus 1. Accordingly, the rotational member 29 can rotate in the same direction as the insertion direction of the process unit 2 without resisting against the insertion of the process unit 2, and hence, the process unit 2 can be easily attached to the image forming apparatus 1.

Figure 18:
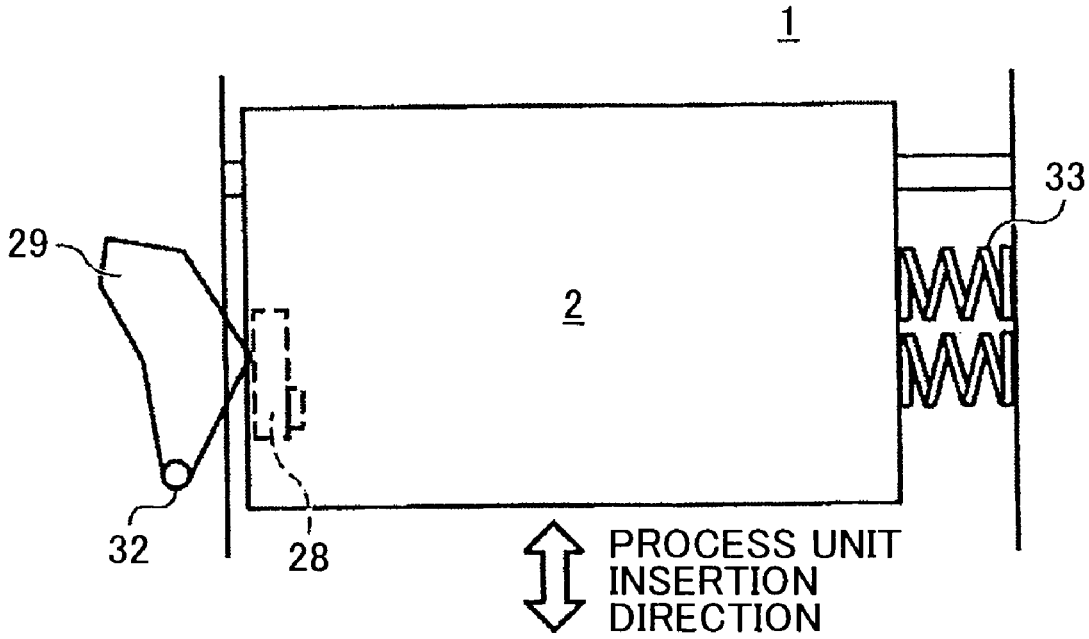
FIG. 18 is a plan view illustration in which the process unit is attached to the main body of the image forming apparatus according to the first embodiment of the invention.

FIG. 18 is a plan view illustrating a state in which the process unit is attached to the main body of the image forming apparatus 1 according to the first embodiment. As illustrated in FIG. 18, the process unit 2 is thrust toward the back of the image forming apparatus 1 via a spring 33 attached to the image forming apparatus 1. With this configuration, the distance between the rotational member 29 and the arm 28 is reduced. In addition, since the rotational member 29 is pressed by constant force, the detection operation may be stabilized.

Figure 19A:
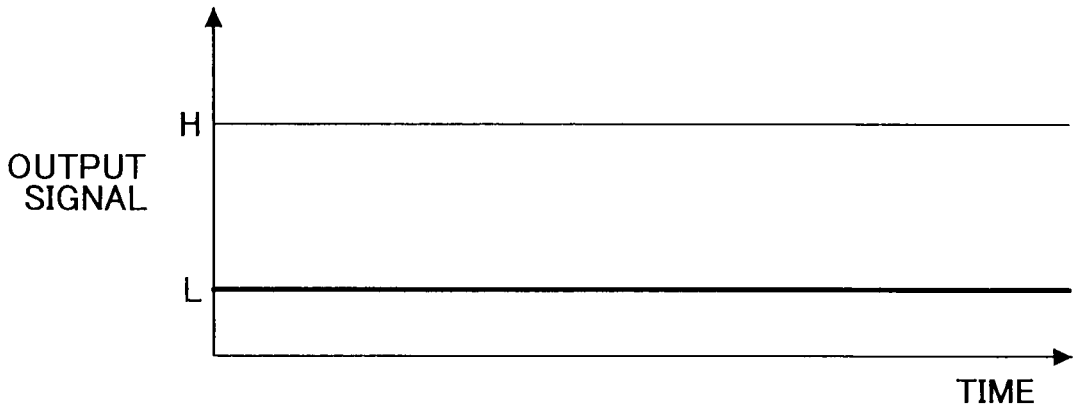
FIGS. 19A and 19B illustrate an aspect of diagrams illustrating a signal output from an optical sensor according to the first embodiment.
Figure 19B:
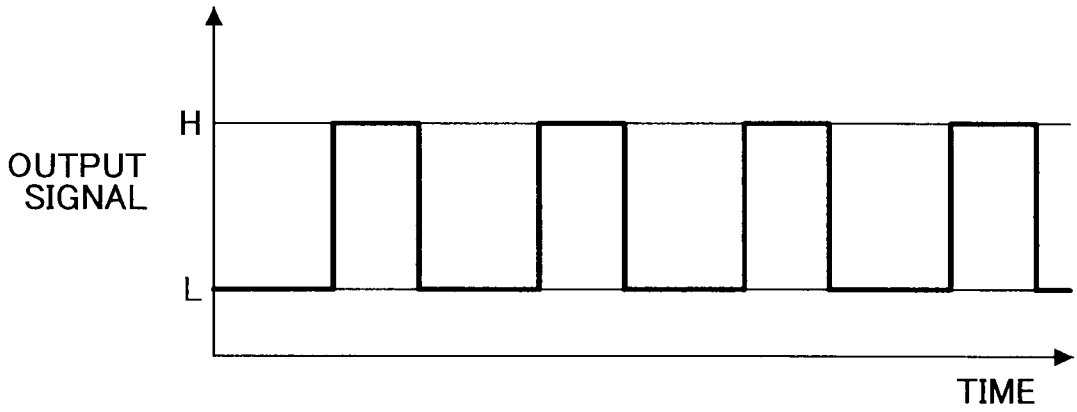

FIGS. 19A and 19B are diagrams illustrating a signal output from the optical sensor 30. The optical sensor 30 processes a signal output from the light-receiving device 302 and outputs the processed signal as a final detection output signal. In a case where the toner remains in the development chamber 35 of the development device 20, a level L signal is output as illustrated in FIG. 19A. In a case where little toner remains in the development chamber 35, the rotational member 29 cuts off the light beam of the optical sensor 30 in the rotational cycle of the stirring and conveyor member 24, so that the optical sensor 30 generates a level H pulse corresponding to the cut-off of the light beam of the optical sensor 30 as illustrated in FIG. 19B. If the intensity of the signal H and tasks are set to the optical sensor 30, the optical sensor 30 detects a signal corresponding the remaining amount of toner, processes the signal, and outputs the processed signal as the final detection output signal.

Figure 20A:
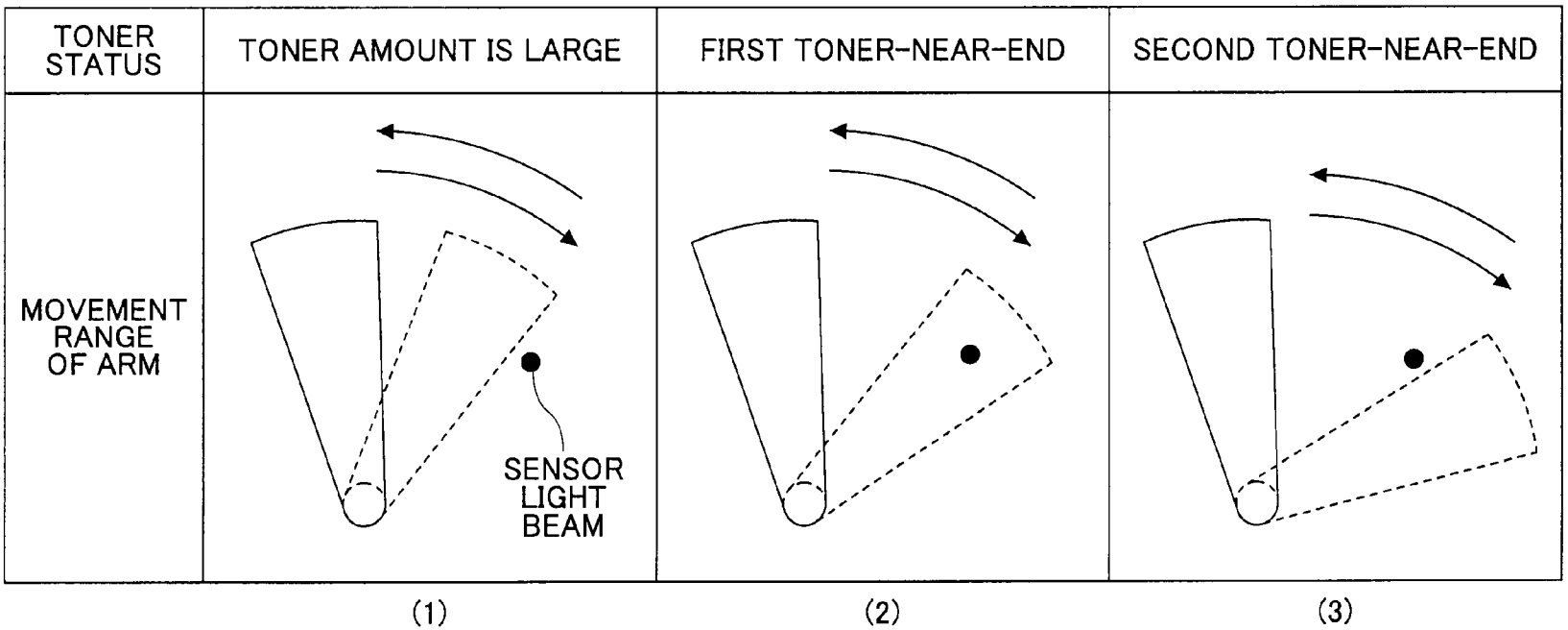
FIGS. 20A and 20B illustrate another aspect of diagrams illustrating the signal output from the optical sensor according to the first embodiment.
Figure 20B:
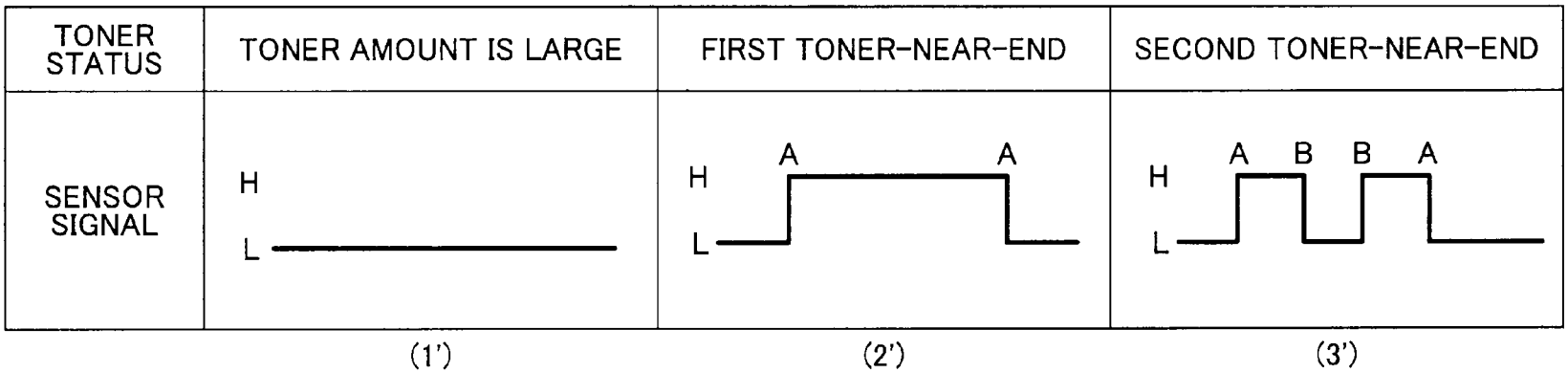

Alternatively, a signal output from the optical sensor 30 may be determined by a control section 500 (see FIG. 2). FIGS. 20A and 20B are diagrams illustrating a signal output from the optical sensor 30 in such a configuration. In this example, a reflection optical sensor 30 is used as the optical sensor. In addition, the first toner-near-end can be detected by directly detecting the rotational angle or the arm 28 without having the rotational member 29. In FIGS. 20A and 20B, (1) to (3) illustrate the movement and fluctuation ranges of the arm 28, whereas (1') to (3') illustrate signals obtained by the corresponding movement and fluctuation ranges (1) to (3). The reflection optical sensor 30 is adapted to a rotational path of the arm 28. The light beam emitted from the light-emitting device of the reflection optical sensor 30 is reflected by facing the arm 28A, and the reflected light beam is then received by the light-receiving device of the reflection optical sensor 30. Thereafter, the reflection optical sensor 30 outputs the received light beam as the level H signal. However, if the arm 28A misses the light beam emitted from the light-emitting device, that is, the arm 28A is off of the emission light axis, the reflection optical sensor 30 generates a level L signal. Accordingly, in a case where the toner remains in the development chamber 35 of the development device 20, the level L signal is output as illustrated in (1') of FIG. 20B. By contrast, in a case where little toner remains in the development chamber 35, the rotational member 29 cuts off the light beam of the optical sensor 30 in the rotational cycle of the stirring and conveyor member 24. Accordingly, the optical sensor 30 generates the level H pulse corresponding to the cut-off of the light beam of the optical sensor 30 as illustrated in (2') or (3') of FIG. 20B. In the first embodiment, a case illustrated in (3') of FIG. 20B (e.g., two sequential generations of level H pulses) is determined (detected) as the tone-near-end.

Note that if two sequential generations of level H pulses while the toner is being supplied once is immediately determined as the first toner-near-end, the first toner-near-end detection may result in low accuracy. That is, the first toner-near-end detection in this case may result from inconsistent toner conveyance or unevenly distributed toner in the development chamber 35. Thus, it is preferable that the first toner-near-end be determined in a case where the level H pulse is sequentially generated N times or more (e.g., three or more). Conversely, if the level H pulse is not sequentially generated N times or more, the first toner-near-end will not be determined.

Figure 21A:
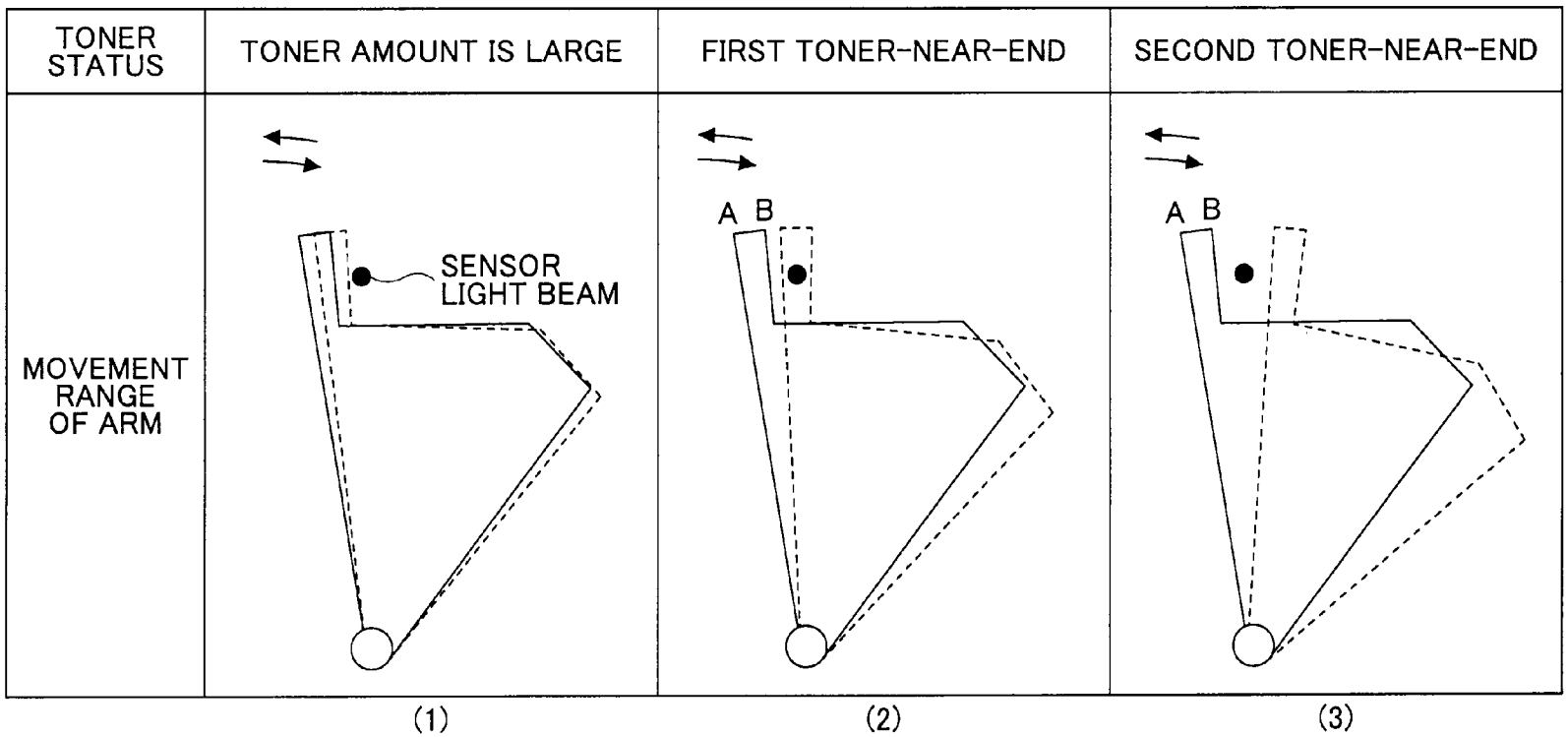
FIGS. 21A and 21B illustrate another aspect of diagrams illustrating the signal output from the sensor according to modification.
Figure 21B:
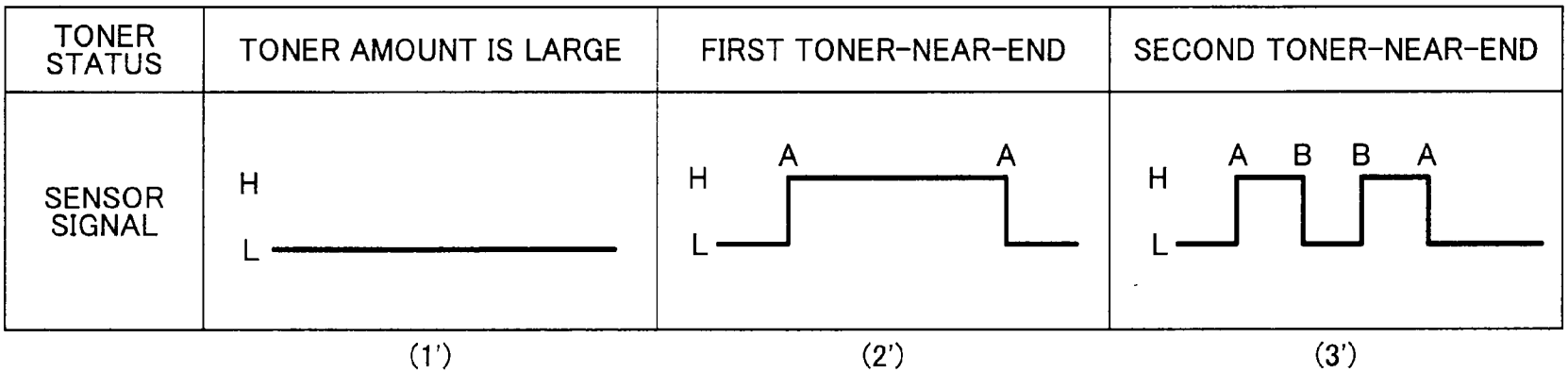

FIGS. 21A and 21B illustrate a signal output from the optical sensor 30 according to a modification. In this modification, only the shape of the arm 28 is different from the above first embodiment, and the operation remains the same. The reflection optical sensor 30 is adapted to a rotational path of a narrow width portion formed at a point of the arm 28. The light beam emitted from the light-emitting device of the reflection optical sensor 30 is reflected by facing the narrow width portion formed at the point of the arm 28A, and the reflected light beam is then received by the light-receiving device of the reflection optical sensor 30. Thereafter, the reflection optical sensor 30 outputs the received light beam as the level H signal. However, if the narrow width portion formed at the point of the arm 28A misses the light beam emitted from the light-emitting device, that is, the narrow width portion formed at the point of the arm 28A is off of the emission light axis, the reflection optical sensor 30 generates a level L signal. According to the modification, in a case where the toner remains in the development chamber 35 of the development device 20, the level L signal is output as illustrated in (1') of FIG. 21B, in the manner similar to the above first embodiment. By contrast, in a case where little toner remains in the development chamber 35, the rotational member 29 cuts off the light beam of the optical sensor 30 in the rotational cycle of the stirring and conveyor member 24. Accordingly, the optical sensor 30 generates the level H pulse corresponding to the cut-off of the light beam of the optical sensor 30 as illustrated in (2') or (3') of FIG. 20B. In this modification, a case illustrated in (3') of FIG. 20B (e.g., two sequential generations of level H pulses) is determined (detected) as the tone-near-end.

Next, a configuration and the operation of an electronic circuit in relation to the detection of the remaining amount of toner are described by referring to the block diagram of FIG. 2. FIG. 2 illustrates an image process unit 400 converting print data into printable signals, the control unit 500, and the process unit 2.

As illustrated in FIG. 2, the electrophotographic image forming apparatus according to the first embodiment includes the image process unit 400 that includes an image deployment section 441, an image memory 442, an image data output section 443, and an image clock generation section 444. The process unit 2 includes a remaining amount of toner detection section (mechanical section) 550 that is one of components used for a remaining amount of developer detection section, and a storage section 560. The storage section 560 stores a reference value of the remaining amount of toner (hereafter called a "remaining amount of toner reference value") and an accumulated count value described later. An amount of toner supplied at the time of shipping that is unique to the process unit 2 is set for the remaining amount of toner reference value as a shipping initial setting value. The accumulated count value is updated with a latest value by sequentially accumulating toner usage time information corresponding to the toner consumption. The accumulated count value is initialized when the remaining amount of developer is reduced to the first threshold (details are described later).

The control unit 500 of the image forming apparatus includes a modulator 520, a laser emission device 521 connected to the modulator 520, a counter 522, a clock pulse generation section 523, a reader-writer section 524, a conversion section (i.e., number of printable sheets computation section according to the first embodiment) 525, a CPU 526, a remaining amount of toner detection circuit (remaining amount of developer detection section) 528, a display device 527, and the optical sensor 30. The remaining amount of toner detection circuit 528 that is one of components used for a remaining amount of developer detection section is connected to the optical sensor 30 that acquires a signal corresponding to the operation of the remaining amount of toner detection section (mechanical section) 550.

In FIG. 2, print data fv supplied from a host computer (not shown), and the like are input to the image process unit 400, then the print data fv input to the image process unit 400 are deployed as dot data in the image deployment section 441. The deployed print data are temporarily stored in the image memory 442 and converted into serial image signals by the image data output section 443. The serial image signals are then transmitted from the image data output section 443 to the control unit 500. The image clock generation section is a section to generate image clocks.

The image signals transmitted to the control unit 500 (image forming apparatus main body) are modulated into a pulse train of laser input voltages corresponding to ON or OFF of the laser beam emitted from the laser emission device 521. In the first embodiment, emission time of the laser beam corresponding to pixels having intermediate color density is reduced corresponding to multivalued signals. Thus, the laser emission device 521 is connected to the modulator 520, so that the laser emission device 521 emits the laser beam based on the modulated signals.

The modulator 520 is connected to the counter 522. The counter 522 measures time information corresponding to output time from the modulator 520 to the laser emission device 521; that is, laser illumination time of the photoreceptor (photoconductor drum) 3 exposed with the laser beam emitted by the laser emission device 521.

That is, the counter 522 is connected to the clock pulse generation section 523 such as a quartz oscillator, and uses a value t for the number of clock pulses received in a period in which the laser emission signals persist as the time information. The measured number of clock pulses are sequentially written by the reader-writer section 524 into the storage section 560 attached to the process unit 2, so that an accumulated value T is sequentially accumulated.

According to the first embodiment, the laser illumination time is directly counted based on the number of clock pulses. For example, a toner consumption amount can be detected by converting multivalued signals, by which laser illumination time corresponding to one dot pixel having high color density can be increased and laser illumination time corresponding to one dot pixel having intermediate color density can be reduced, into the time information.

Accumulated time information (accumulated value T obtained by accumulating the clock pulse count value t) written in the storage section 560 is re-read by the reader-writer section 524 of the control unit 500 and then the read accumulated time information is input to the conversion section (number of printable sheets computation section) 525. The conversion section (number of printable sheets computation section) 525 is connected to the CPU 526, and computes an amount of toner consumed (toner consumption amount) corresponding to a unit count (unit time) set in to the CPU 526 in advance.

That is, the accumulated value T is converted into the toner consumption amount N grams by the following equation (1).

$$N(g)=T\times L(g) \tag{1}$$

In equation (1), L represents an amount of toner consumed per unit count. The computed consumption toner amount N is transmitted to the CPU 526, in which the number of printable sheets is computed by the following equation (2), based on an amount of toner supplied at the time of manufacture (initial amount of toner). The computed number of printable sheets is then displayed by the display device 527 to inform a user of the number of currently printable sheets.

$$K(\text{sheets})=(J(g)-N(g))/S(g/\text{sheet}) \tag{2}$$

In equation (2), J(g) represents the amount of toner supplied in the cartridge at the time of shipping, S represents the amount of toner consumed per sheet based on the standard printing ratio, and R represents the threshold amount of toner at which a white patch appears on a printed sheet caused by insufficient deposition of toner. Note that after the detection of the first toner-near-end, the number of printable sheets is computed as follows. The consumption toner amount N (equation (1)) is computed, and then the number of currently printable sheets is computed based on the final reference value M' (g) predetermined corresponding to the first threshold. Thereafter, the computed number of printable sheets is displayed by the display device 527 to inform the user of the number of currently printable sheets.

$$K(\text{sheets})=(M'(g)-N(g))/S(g/\text{sheet}) \quad (3)$$

Referring to FIG. 2, the remaining amount of toner detection section 550 detects that the amount of toner is equal to or lower than the first threshold, and the first toner-near-end is detected in the first place. In this case, the count value of the accumulated laser illumination time stored in the storage section 560 is sequentially written in the storage section 560 by the reader-writer section 524 in a period from the start of use of the process unit 2 (step S1) to the remaining amount of toner detection circuit 528 reporting the first toner-near-end. The number of printable sheets corresponding to the count value is computed by the conversion section (number of printable sheets computation section} 525 based on the remaining amount of toner reference value (supplied toner amount at the time of shipping) initialized based on the initial amount of toner supply retrieved by the reader-writer section 524. By contrast, after the first toner-near-end has been detected, the accumulated count value is reset and the predetermined final remaining amount of toner reference value is set again. Thereafter, the reader-writer section 524 sequentially reads the accumulated value from and writes the accumulated value into the storage section 560.

Next, first and second toner-near-end detection operations and a remaining amount of developer detection (remaining amount of toner detection section) operation are specifically described below with reference the flowchart illustrated in FIG. 22. In the following description, the first toner-near-end detection operation carried out by the remaining amount of toner detection section is described first, and a second toner-near-end (or second toner-end) detection operation, which is a more accurate detection of the remaining amount of toner, specifically carried out by an operation amount computation section after the first toner-end detection operation is subsequently described.

Figure 22:
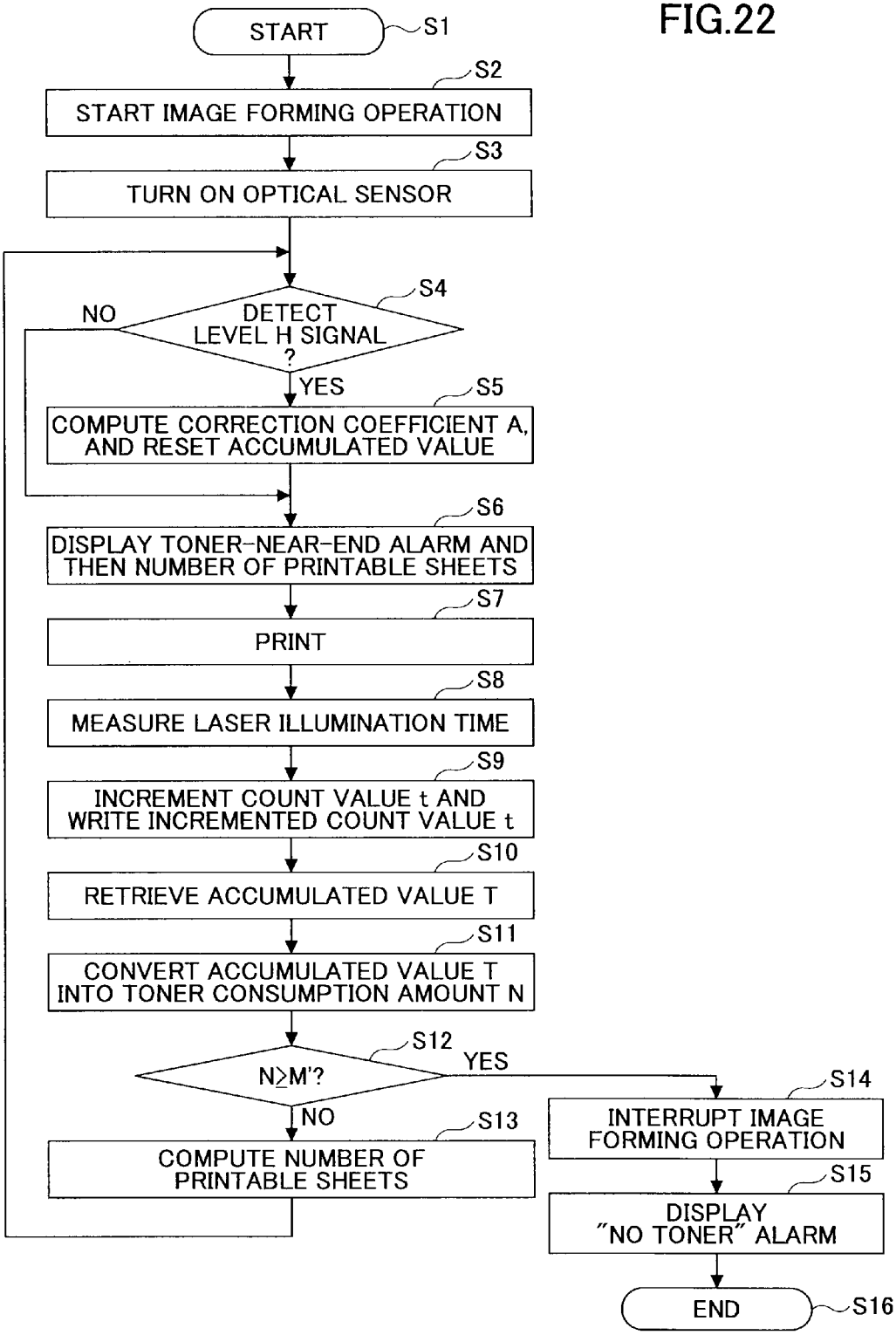
FIG. 22 is a flowchart illustrating first and second toner-near-end detection operations.

As illustrated in FIG. 22, the image forming operation starts when a user presses a copy button or a print-start button of the image forming apparatus 1 (step S2). Simultaneously, the optical sensor for detecting the first toner-near-end is turned ON (step S3).

That is, in the development device 20 according to the first embodiment, the remaining amount of toner detection circuit 528 detects a remaining amount of toner, and notifies the user, provided that the first toner-near-end is detected, of the first toner-near-end status by displaying that status on the display device 527. The first toner-near-end detection carried out by the remaining amount of toner detection section can be combined with a second toner-near-end detection carried out by the operation amount computation section. In the first toner-near-end detection, the detection member 27 is provided near the supply roller 22 supplying the toner to the development roller 21 developing the latent image on the photoreceptor 3. Since the detection member can detect the remaining amount of toner near the supply roller 22 in the development chamber 35, the detection member 27 can determine whether the toner is reduced to the predetermined amount. The rotation of the detection member 27 is transmitted to the image forming apparatus, and the remaining amount of toner is detected (first toner-near-end detection) by the optical sensor of the image forming apparatus 1. The remaining amount of toner detection circuit 528 detects the first toner-near-end status by detecting a signal H in FIG. 19 corresponding to the rotation of the detection member 27 output from the optical sensor 30 (step S4).

When the signal H is detected only once in step S4, it is not preferable to immediately determine the first toner-near-end status in the development chamber 35. The signal H may be generated due to the inconsistent toner conveyance or maldistribution of toner in the development chamber 35. For example, it is preferable the first toner-near-end be determined when the signal H is sequentially generated N times. In step S4, the first toner-near-end detection is determined when the signal H is obtained twice or more times while the toner supply operation is carried out.

When the first toner-near-end detection is determined in step S4, a detected time setting process for determining a second-toner-near-end (toner-end) that will be described later is carried out (step S5). Thereafter, information on the first toner-near-end alarm is displayed (step S6), and then the printing operation is carried out (step S7). On the other hand, when the signal H is not generated twice or more times in step S4, the first toner-near-end detection is not determined, so that the process directly goes from step S4 to the step S6, and the printing operation is carried out (step 7). So far, the first toner-near-end detection (determination) carried out by the remaining amount of toner detection circuit (i.e., remaining amount of developer detection section) and detection time setting process (step S5) have been described.

Subsequently, a description is given for the remaining amount of toner detection process that is carried out using a development device operation amount computation section (i.e., second toner-near-end detection) after the determination of the first toner-near-end has been carried out in step S4. In the following description, it is assumed that the first toner-near-end detection is not determined in step S4. After the information relating to the remaining amount of toner is displayed (i.e., number of currently printable sheets are displayed by % before a first toner-near-end detection alarm) in step S6, the clock pulse count value t corresponding to the laser illumination time for the printing operation (step S7) is measured (step S8). Thereafter, the measured clock pulse count value t is stored in the storage section 560. Next, the accumulated value T obtained by accumulating the clock pulse count values t up to the present is read (step S10). The accumulated count value T is converted into a toner consumption amount N grams by the above equation (1); that is, N (g)=T×L (g) (step S11).

Subsequently, whether the toner consumption amount N has reached a predetermined value (predetermined image forming threshold) or more is determined to detect a second toner-near-end (i.e., toner-end) status (step S12). In the first embodiment, if the consumption toner amount N is equal to or more than a final reference value M' grams (second threshold) determined as a predetermined image forming threshold (i.e. N≧M'), the remaining amount of toner is determined to have the second toner-near-end status. The CPU 526 compares the toner consumption amount N converted from the clock pulse count value t with the final reference value M' (step S12). If N<M', the number of currently printable sheets K is computed by the above equation (3) (step S13), and processes in Steps S4 to S12 are repeated. If the first toner-near-end detection is not determined in step S4, the above sequence of operations are repeated while the toner consumption amount N obtained in step S12 is smaller than the final reference value M' (N<M').

If the first toner-near-end detection is determined in step S4, the detection time setting process (step S5) is carried out. In step S5, the accumulated value T obtained by accumulating clock pulse count values t up to the present is initially read by the control unit 500 to compute a correction coefficient A by the following equations (4) and (5).

$$L'(g)=(J(g)-M(g))/T \quad (4)$$

In equation (4), J(g) represents the amount of toner supplied in the cartridge at the time of shipping.

$$A=L'/L \quad (5)$$

In equation (5), L(g) represents an amount of toner consumed per unit count.

Next, the CPU 256 resets the accumulated value T stored in the storage section 60. Thereafter, the user is notified by alarm that the remaining amount of toner is the first toner-near-end status, and the number of currently printable sheets based on the standard printing ratio of 500 sheets is displayed on the display device 527 (step S6). When the printing operation is executed (step S7), a clock pulse count value t2 corresponding to the laser illumination time for printing is measured (step S8). The measured clock pulse count value t2 is newly stored in the storage section 560 that has been reset by the CPU 526 (step S9). The accumulated value T of the clock pulse count value t2 newly stored in the storage section 560 is then read by the image forming apparatus main body (i.e., control unit 500) again (step S10), and the retrieved accumulated value T is converted into the toner consumption amount N grams by the above equation (1) (step S11).

Thereafter, the CPU 526 compares the toner consumption amount N with the final reference value M' (Step S12). If N<M', the number of currently printable sheets K is computed by the above equation (3) (Step S13), and processes in Steps S4 to S12 are repeated.

$$K(\text{sheets})=(M'(g)-N(g))/S(g)/\text{sheet}) \quad (3)$$

In step S12, if the consumption toner amount N is equal to or more than the final reference value M' (N≧M') and the remaining amount of toner is determined to have the second toner-near-end status (i.e., toner-end status), the image forming operation is interrupted (step S14) and a toner-end alarm is displayed on a monitor of the display device 527 (step S15). Accordingly, the user is notified by alarm of "no toner" so that the user can replace the process unit 2 with a new one in this manner.

In the above first embodiment, since the first toner-near-end is mechanically detected accurately, a more accurate number of currently printable sheets may be computed for the second-toner-near-end (toner-end) during a remaining amount of toner monitoring process after the first toner-near-end detection than that in the disclosed related art inventions. Accordingly, the second-toner-near-end (toner-end) can be detected more accurately. Note that the cartridge of this type in the first embodiment may be removable. In the first embodiment, the storage section is provided in the cartridge, so that the correction amount of toner can be computed based on the accumulated count value on the printed amount information from the initial setting, which is obtained by the operation amount computation section. In this case, the number of currently printable sheets may be computed more accurately than in a case where plural cartridges are simultaneously provided in one image forming apparatus main body. Note that the remaining amount of toner may not be displayed until the first toner-near-end detection is completed.

Note also that in the first embodiment, the count value obtained based on the laser illumination time is used as information on an amount of toner consumed for printing (computed by the development device operation amount computation section). Alternatively, other information may be used as the information on an amount of toner consumed for printing such as counting of the number of dots obtained by the image deployment in a second embodiment that can be computed by the development device operation amount computation section.

Figure 23:
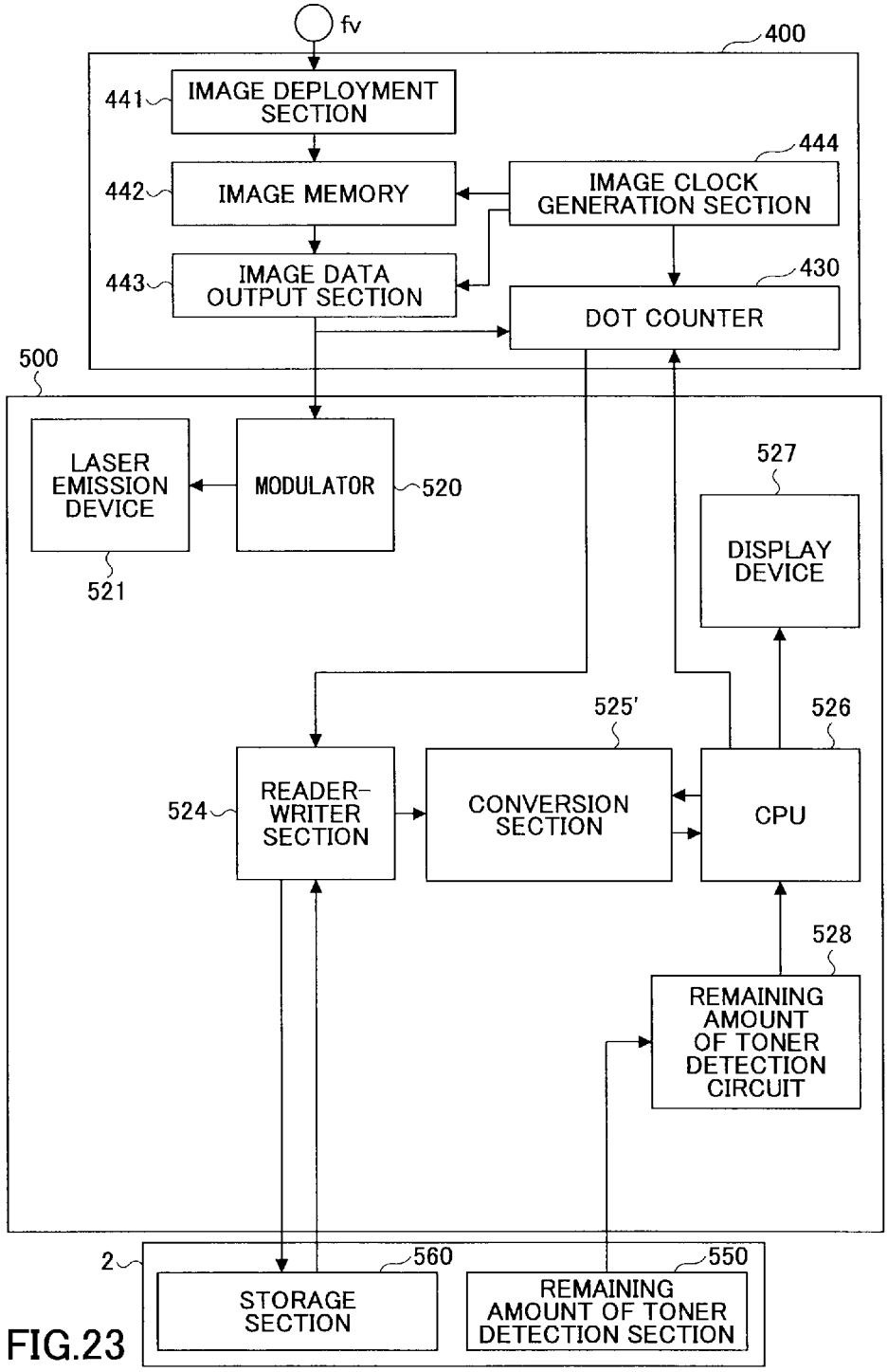
FIG. 23 is a circuit block diagram of an image forming apparatus according to a second embodiment of the invention.

FIG. 23 is a lock diagram illustrating a configuration of a development device according to the second embodiment having a different configuration from the first embodiment. In FIG. 23, the components identical to those of the first embodiment are provided with the same reference numerals and the descriptions of the configuration and the operations of the second embodiment are therefore omitted. The second embodiment differs from the first embodiment in that the image process unit 400 includes a dot counter 430 that directly counts the number of dots obtained by the image deployed in the image process unit 400 as information on an amount of toner consumed for printing, and the counted value is stored in the storage section 560 in the process unit 2.

In FIG. 23, the dot counter 430 measures the number of dots of the image formed of serial image signals and image clocks output by the image data output section 443. The count value obtained by the measurement of the number of printing dots is transmitted to the image process unit 400, and the transmitted count value is sequentially accumulated and written in the storage section 560 in the process unit 2 via the reader-writer section 524. The count value written in the storage section 560 is converted by a conversion section 525' into an amount of toner consumed for printing, and the obtained amount of toner consumed for printing is transmitted to the CPU 526.

The count value written in the storage section 560 is re-read by the reader-writer section 524 of the control unit 500 and then the read count value is input to the conversion section 525'. The conversion section 525' is connected with the CPU 526, and computes an amount of toner consumed (consumption toner amount) corresponding to a unit time set to the CPU 526 in advance. The computed consumption toner amount is transmitted to the CPU 526, which computes the number of currently printable sheets with the remaining amount of toner. Thereafter, the user is notified of the computed number of currently printable sheets via the display device 527. In the case where the number of printing dots is counted, the dot counter can directly count the number of dots. Accordingly, the circuit can be simply configured to provide cost effectiveness as compared to the first embodiment where the count value is obtained via the image signals and the image clock signals.

In addition, an operation amount of the development device 20 can be obtained by counting the number of latent images to be formed (i.e., number of printable sheets) with the developer consumption (toner consumption). In this case, the number of printed sheets is recorded in the storage section, and the consumption toner amount may be computed based on the amount of toner consumed per sheet based on the standard printing ratio.

In the above embodiments, the user is notified of the first toner-near-end detected by the remaining amount of toner by displaying the toner-near-end status on the display device; however, the embodiments are not limited thereto. A third threshold (threshold corresponding to 200 sheets) that is larger than the second threshold may be provided for determining the toner-near-end detection. For example, when the first toner-near-end detection is detected, this detection is not treated as the first toner-near-end status so that the first toner-near-end status is not displayed. The first toner-near-end is determined based on the third threshold; that is, based on whether the toner consumption amount is equal to or larger than the third threshold. When the toner consumption amount is equal to or larger than the third threshold, the first toner-near-end status is displayed. Thereafter, the process of the second-toner-near-end detected by the development device operation amount detected section is initiated and determined based on the second threshold described above. Alternatively, the first-toner-near-end detection in this case may be displayed twice based on the first and third thresholds.

As described above, according to the embodiments of the present invention, after the remaining amount of toner is directly detected by the remaining amount of toner detection section with accuracy (first toner-near-end detection), the number of currently printable sheets corresponding to the current toner consumption amount is computed (second toner-near-end detection). Thus, the number of currently printable sheets may be computed more accurately than that computed by the related art image forming apparatuses, in which the toner-near-end is computed based on the accumulated toner consumption information from the initial setting.

Note that the above embodiments are described based on a reversal development system in which toner is attached to a laser illumination region of the electrophotographic photoreceptor. However, the embodiments may be applied to a traditional development system in which laser non-illumination time is measured by the counter, and toner is attached to a non-laser-illumination region of the electrophotographic photoreceptor.

According to the embodiments of the invention, the remaining amount of developer detection section is provided near the supply roller in a container that conveys the developer (toner) to the supply roller. With this configuration, the remaining amount of developer (toner) in the development device can be accurately detected. Accordingly, the threshold of the toner-near-end may be set to 100 sheets corresponding to the remaining amount of developer (toner). Moreover, the remaining amount of toner and toner-near-end can be accurately detected based on the advantages of the remaining amount of toner detection (detection accuracy is excellent when the remaining amount of toner corresponds to 100 sheets or more) computed based on the operation amount corresponding to the consumption developer (toner) amount.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiment of the present invention has been described in detail, it should be understood that various changes, substitutions, and alterations could be made hereto without departing from the spirit and scope of the invention.

This patent application is based on Chinese Priority Patent Application No. 200910129036.9 filed on Mar. 12, 2009, the entire contents of which are hereby incorporated herein by reference.

What is claimed is:

1. A remaining amount of developer detection device comprising:

a remaining amount of developer detection section configured to detect a remaining amount of developer in a development device;

an operation amount computation section configured to compute an operation amount of the development device corresponding to a developer consumption amount of the development device; and a remaining amount detection control section configured to accumulate in a storage section the operation amount of the development device corresponding to the developer consumption amount of the development device computed by the operation amount computation section and detect the remaining amount of developer in the development device based on the accumulated operation amount stored in the storage section, wherein the remaining amount of developer detection section includes:

a detection member configured to change a rotational position corresponding to the remaining amount of developer in the development device and include a rotational shaft and a plate-like member attached to the rotational shaft and located near a supply member that supplies a developer in a direction toward a development region such that the plate-like member goes up in a direction in which a distance between the plate-like member and the supply member is increased and goes down in a direction in which a distance between the plate-like member and the supply member is decreased in a space in the development device;

a driving force transmission device configured to apply a driving force to the detection member at a time of detecting the remaining amount of developer in the development device such that the plate-like member goes up in the direction in which the distance between the plate-like member and the supply member is increased and goes down in the direction in which the distance between the plate-like member and the supply member is decreased; and a sensor configured to detect a rotation state of the plate-like member when the plate-like member goes down to near a lowermost position thereof, wherein provided that the remaining amount of developer detection section has detected the remaining amount of developer that has been reduced to a first threshold, the remaining amount detection control section initializes the accumulated operation amount stored in the storage section and starts accumulating in the storage section a new operation amount of the development device corresponding to a developer consumption amount of the development device computed by the operation amount computation section, and determines whether the remaining amount of developer in the development device is in a toner-end status based on the new operation amount accumulated in the storage section.

2. The remaining amount of developer detection device as claimed in claim 1, wherein the driving force transmission device alternately controls the detection member to raise the plate-like member by the application of the driving force thereto and to lower the plate-like member by restricting a lowermost position thereof.

3. The remaining amount of developer detection device as claimed in claim 1, wherein the rotational shaft of the detection member is located higher than a rotational shaft of the supply member.

4. The remaining amount of developer detection device as claimed in claim 1, further comprising:

a developer carrier configured to carry a developer to the development region, wherein the rotational shaft of the detection member is located higher than a contact region between the supply member and the developer carrier.

5. The remaining amount of developer detection device as claimed in claim 1, wherein the rotational shaft of the detection member further includes a spring member that gives rotational force to the detection member by spring force, and wherein a load for fixing the rotational shaft is ⅕ or less of the spring force of the spring member that gives the rotational force to the detection member.

6. The remaining amount of developer detection device as claimed in claim 1, wherein the detection member further includes an opening.

7. The remaining amount of developer detection device as claimed in claim 1, wherein a gap between the detection member and an enclosure of the development device is 3 mm or less in a region of 80% or more in a longitudinal direction of the detection member.

8. The remaining amount of developer detection device as claimed in claim 1, wherein the operation amount computation section computes the operation amount of the development device corresponding to the developer consumption amount of the development device by counting a number of pixels of a latent image.

9. The remaining amount of developer detection device as claimed in claim 1, wherein the operation amount computation section computes the operation amount of the development device corresponding to the developer consumption amount of the development device by counting a number of latent images.

10. A development device comprising:

a remaining amount of developer detection device including:

a remaining amount of developer detection section configured to detect a remaining amount of developer in a development device;

an operation amount computation section configured to compute an operation amount of the development device corresponding to a developer consumption amount of the development device; and a remaining amount detection control section configured to accumulate in a storage section the operation amount of the development device corresponding to the developer consumption amount of the development device computed by the operation amount computation section and detect the remaining amount of developer in the development device based on the accumulated operation amount stored in the storage section, wherein the remaining amount of developer detection section includes:

a detection member configured to change a rotational position corresponding to the remaining amount of developer in the development device and include a rotational shaft and a plate-like member attached to the rotational shaft and located near a supply member that supplies a developer in a direction toward a development region such that the plate-like member goes up in a direction in which a distance between the plate-like member and the supply member is increased and goes down in a direction in which a distance between the plate-like member and the supply member is decreased in a space in the development device;

a driving force transmission device configured to apply a driving force to the detection member at a time of detecting the remaining amount of developer in the development device such that the plate-like member goes up in the direction in which the distance between the plate-like member and the supply member is increased and goes down in the direction in which the distance between the plate-like member and the supply member is decreased; and a sensor configured to detect a rotation state of the plate-like member when the plate-like member goes down to near a lowermost position thereof, wherein provided that the remaining amount of developer detection section has detected the remaining amount of developer that has been reduced to a first threshold, the remaining amount detection control section initializes the accumulated operation amount stored in the storage section and starts accumulating in the storage section a new operation amount of the development device corresponding to a developer consumption amount of the development device computed by the operation amount computation section, and determines whether the remaining amount of developer in the development device is in a toner-end status based on the new operation amount accumulated in the storage section.

11. The development device as claimed in claim 10, further comprising:

a container chamber configured to contain a developer;

a development chamber including a developer carrier configured to carry the developer to the development region, and a supply member configured to supply the developer to the developer carrier;

a partition provided between the container chamber and the development chamber to separate therebetween; and a transmission section provided on an external surface of the development device and configured to transmit a rotational position of the detection member outside, wherein the container chamber includes a stirring and conveyor member configured to convey the developer from the container chamber to the development chamber while stirring, and wherein the development chamber includes the detection member such that the remaining amount of developer is detected based on the rotational position of the detection member.

12. The development device as claimed in claim 11, wherein an upper edge of the partition provided between the development chamber and the container chamber is located at a same level with or a predetermined distance lower than a highest position in a movement range of the detection member.

13. The development device as claimed in claim 10, wherein the rotational shaft of the detection member is located higher than a rotational shaft of the supply member.

14. The development device as claimed in claim 10, further comprising:

a developer carrier configured to carry a developer to the development region, wherein the rotational shaft of the detection member is located higher than a contact region between the supply member and the developer carrier.

15. The development device as claimed in claim 10, further comprising:

a stirring and conveyor member configured to stir and convey the developer, wherein a rotation of the detection member is configured to be in synchronization with a rotation of the stirring and conveyor member.

16. The development device as claimed in claim 10, further comprising:

a stirring and conveyor member configured to stir and convey the developer, wherein the driving force applied via the driving force transmission device to the detection member is transmitted by a driving force generated by a rotation of the stirring and conveyor member, the driving force transmission device being configured to apply the driving force to the detection member at a time of detecting the remaining amount of developer in the development device.

17. The development device as claimed in claim 10, further comprising:

a stirring and conveyor member configured to stir and convey the developer;

a synchronization member provided between the detection member and the stirring and conveyor member and configured to include levers at both ends thereof and a central shaft; and a cam provided on a rotational shaft of the stirring and conveyor member, wherein the synchronization member is moved in synchronization with the stirring and conveyor member by bringing one of the levers attached to the synchronization member into contact with the cam, and the movement of the synchronization member is transmitted to the detection member by the other lever to drive the detection member.

18. An image forming apparatus comprising:

an image carrier forming a latent image; and a development device developing the latent image with developer, wherein the development device includes a remaining amount of developer detection device including:

a remaining amount of developer detection section configured to detect a remaining amount of developer in the development device;

an operation amount computation section configured to compute an operation amount of the development device corresponding to a developer consumption amount of the development device; and a remaining amount detection control section configured to accumulate in a storage section the operation amount of the development device computed corresponding to the developer consumption amount of the development device computed by the operation amount computation section and detect the remaining amount of developer in the development device based on the accumulated operation amount stored in the storage section, wherein the remaining amount of developer detection section includes:

a detection member configured to change a rotational position corresponding to the remaining amount of developer in the development device and include a rotational shaft and a plate-like member attached to the rotational shaft and located near a supply member that supplies a developer in a direction toward a development region such that the plate-like member goes up in a direction in which a distance between the plate-like member and the supply member is increased and goes down in a direction in which a distance between the plate-like member and the supply member is decreased in a space in the development device;

a driving force transmission device configured to apply a driving force to the detection member such that the plate-like member goes up in the direction in which the distance between the plate-like member and the supply member is increased and goes down in the direction in which the distance between the plate-like member and the supply member is decreased; and a sensor configured to detect a rotation state of the plate-like member when the plate-like member goes down to near a lowermost position thereof, wherein provided that the remaining amount of developer detection section has detected the remaining amount of developer that has been reduced to a first threshold, the remaining amount detection control section initializes the accumulated operation amount stored in the storage section and starts accumulating in the storage section a new operation amount of the development device corresponding to a developer consumption amount of the development device computed by the operation amount computation section, and determines whether the remaining amount of developer in the development device is in a toner-end status based on the new operation amount accumulated in the storage section.

* * * * *